US006586727B2

(12) United States Patent
Bateman et al.

(10) Patent No.: US 6,586,727 B2
(45) Date of Patent: Jul. 1, 2003

(54) METHODS AND APPARATUS FOR MASS SPECTROMETRY

(75) Inventors: Robert Harold Bateman, Knutsford (GB); John Brian Hoyes, Stockport (GB)

(73) Assignee: Micromass Limited, Manchester (GB)

( * ) Notice: Subject to any disclaimer, the term of this patent is extended or adjusted under 35 U.S.C. 154(b) by 132 days.

(21) Appl. No.: 09/796,544

(22) Filed: Mar. 2, 2001

(65) Prior Publication Data

US 2001/0052569 A1 Dec. 20, 2001

(30) Foreign Application Priority Data

Jun. 9, 2000 (GB) ..... 0014062
Jan. 15, 2001 (GB) ..... 0101048

(51) Int. Cl.[7] ..... H01J 49/40
(52) U.S. Cl. ..... 250/282; 250/281; 250/287
(58) Field of Search ..... 250/281, 282, 250/287

(56) References Cited

U.S. PATENT DOCUMENTS 5,073,713 A * 12/1991 Smith et al. ..... 250/282
5,661,298 A 8/1997 Bateman
6,107,623 A 8/2000 Bateman et al.
6,323,482 B1 * 11/2001 Clemmer et al. ..... 250/287

FOREIGN PATENT DOCUMENTS

EP 1006559 6/2000
GB 2120007 11/1983

OTHER PUBLICATIONS

R.A. Yost and C.G. Enke, "Tandem Quadrupole Mass Spectrometry", A Wiley–Interscience Publication, ch. 8, pp175–195.

Huang and Henion, "Characterization of Cyclodextrins Using Ion–evaporation Atmospheric–pressure Ionization Tandem Mass Spectrometry", Rapid Communications in Mass Spectrometry, vol. 4, No. 11, pp467–471 (1990).

Morris et al., "High Sensitivity Collisionally–activated Decomposition Tandem Mass Spectrometry on a Novel Quadrupole/Orthogonal–acceleration Time–of–Flight Mass Spectrometry", Rapid Communications in Mass Spectrometry, vol. 10, pp889–896 (1996).

Morris et al., "A Novel Geometry Mass Spectrometer, the Q–TOF, for Low–Femtomole/Attomole–Range Biopolymer Sequencing", Journal of Protein Chemistry, vol. 16, No. 5 pp469–479 (1997).

Borchers et al., "Preliminary comparison of precursor scans and liquid chromatography–tandem mass spectrometry on a hybrid quadrupole time–of–flight mass spectrometer", Journal of Chromatography A. 854 pp 119–130 (1999).

(List continued on next page.)

*Primary Examiner*—John R. Lee
*Assistant Examiner*—Paul M. Gurzo
(74) *Attorney, Agent, or Firm*—Diederiks Whitelaw, PLC

(57) ABSTRACT

An improved method of parent ion scanning is disclosed. In one embodiment a quadrupole mass filter 3 upstream of a collision cell 4 is arranged to operate in a highpass mode. Parent ions transmitted by the mass filter 3 are fragmented in the collision cell 4 and detected by an orthogonal time of flight analyser 5 which obtains a daughter ion mass spectrum. Ions having a mass to charge ratio below the cutoff of the mass filter 3 are identified as daughter ions, and candidate parent ions may then be discovered and their identity confirmed by obtaining corresponding daughter ion spectra. In a second embodiment, the collision cell 4 alternates between high and low fragmentation and candidate parent ions can additionally be identified on the basis of the loss of a predetermined ion or neutral particle.

67 Claims, 19 Drawing Sheets

OTHER PUBLICATIONS

Hopfgartner et al., "Exact Mass Measurement of Product Ions for the Structural Elucidation of Drug Metabolites with a Tandem Quadrupole Orthogonal–Acceleration Time–of–Flight Mass Spectrometer", American Society for Mass Spectrometry, 10, pp1305–1314 (1999).

Charlwood et al., "Structural Characterisation of N–Linked Glycan Mixtures by Precursor Ion Scanning and Tandem Mass Spectrometric Analysis", Rapid Communications in Mass Spectrometry, 13, pp1522–1530 (1999).

* cited by examiner

MS High collision energy
-daughter ion spectrum
86.1280
136.1099
147.1472
244.1997
204.1759
251.1417
341.2260
407.1813
428.2524
447.2489
557.2966
720.3365
668.4095
666.3606
723.3681
732.3683
733.3754
836.4373
844.4373
845.4118
868.3767
944.4752
945.4806
946.4739
100
%
0

MS Low collision energy
-parent ion spectrum
418.7224
472.7523
490.7445
491.2518
491.7504
567.2904
568.7813
569.2885
569.8057
599.3012
693.3727
723.3839
724.3849
836.4426
844.4553
944.5047
379.5341
360.6658
100
%
0
50
100
150
200
250
300
350
400
450
500
550
600
650
700
750
800
850
900
950
1000
m/z Total ion chromatogram of ADH tryptic digest Mass chromatogram of 87.04 (Asparagine immonium ion)

Fragment T5 from ADH Sequence ANELLINVK MW 1012.59

Fig.18. Alpha casein 100fmole inj.

METHODS AND APPARATUS FOR MASS SPECTROMETRY

BACKGROUND OF THE INVENTION

The present invention relates to methods and apparatus for mass spectrometry.

Tandem mass spectrometry (MS/MS) is the name given to the method of mass spectrometry wherein parent ions generated from a sample are selected by a first mass filter/analyser and are then passed to a collision cell wherein they are fragmented by collisions with neutral gas molecules to yield daughter (or "product") ions. The daughter ions are then mass analysed by a second mass filter/analyser, and the resulting daughter ion spectra can be used to determine the structure of the parent (or "precursor") ion. Tandem mass spectrometry is particularly useful for the analysis of complex mixtures such as biomolecules since it avoids the need for chemical clean-up prior to mass spectral analysis.

A particular form of tandem mass spectrometry referred to as parent ion scanning is known, wherein in a first step the second mass filter/analyser is arranged to act as a mass filter so that it will only transmit and detect daughter ions having a specific mass-to-charge ratio. The specific mass-to-charge ratio is set so as to correspond with the mass-to-charge ratio of daughter ions which are known to be characteristic products which result from the fragmentation of a particular parent ion or type of parent ion. The first mass filter/analyser upstream of the collision cell is then scanned whilst the second mass filter/analyser remains fixed to monitor for the presence of daughter ions having the specific mass-to-charge ratio. The parent ion mass-to-charge ratios which yield the characteristic daughter ions can then be determined. As a second step, a complete daughter ion spectrum for each of the parent ion mass-to-charge ratios which produce characteristic daughter ions may then be obtained by operating the first mass filter/analyser so that it selects parent ions having a particular mass-to-charge ratio, and scanning the second mass filter/analyser to record the resulting full daughter ion spectrum. This can then be repeated for the other parent ions of interest. Parent ion scanning is useful when it is not possible to identify parent ions in a direct mass spectrum due to the presence of chemical noise, which is frequently encountered, for example, in the electrospray mass spectra of biomolecules.

Triple quadrupole mass spectrometers having a first quadrupole mass filter/analyser, a quadrupole collision cell into which a collision gas is introduced, and a second quadrupole mass filter/analyser are well known. Another type of mass spectrometer (a hybrid quadrupole-time of flight mass spectrometer) is known wherein the second quadrupole mass filter/analyser is replaced by an orthogonal time of flight mass analyser.

As will be shown below, both types of mass spectrometers when used to perform conventional methods of parent ion scanning and subsequently obtaining a daughter ion spectrum of a candidate parent ion suffer from low duty cycles which render them unsuitable for use in applications which require a higher duty cycle i.e. when used in on-line chromatography applications.

Quadrupoles have a duty cycle of approximately 100% when being used as a mass filter, but their duty cycle drops to around 0.1% when then are used in a scanning mode as a mass analyser, for example, to mass analyse a mass range of 500 mass units with peaks one mass unit wide at their base.

Orthogonal acceleration time of flight analysers typically have a duty cycle within the range 1–20% depending upon the relative m/z values of the different ions in the spectrum. However, the duty cycle remains the same irrespective of whether the time of flight analyser is being used as a mass filter to transmit ions having a particular mass to charge ratio, or whether the time of flight analyser is being used to record a full mass spectrum. This is due to the nature of operation of time of flight analysers. When used to acquire and record a daugher ion spectrum the duty cycle of a time of flight analyser is typically around 5%.

To a first approximation the conventional duty cycle when seeking to discover candidate parent ions using a triple quadrupole mass spectrometer is approximately 0.1% (the first quadrupole mass filter/analyser is scanned with a duty cycle of 0.1% and the second quadrupole mass filter/analyser acts as a mass filter with a duty cycle of 100%). The duty cycle when then obtaining a daughter ion spectrum for a particular candidate parent ion is also approximately 0.1% (the first quadrupole mass filter/analyser acts as a mass filter with a duty cycle of 100%, and the second quadrupole mass filter/analyser is scanned with a duty cycle of approximately 0.1%). The resultant duty cycle therefore of discovering a number of candidate parent ions and producing a daughter spectrum of one of the candidate parent ions is approximately 0.1%/2 (due to a two stage process with each stage having a duty cycle of 0.1%)=0.05%.

The duty cycle of a quadrupole-time of flight mass spectrometer for discovering candidate parent ions is approximately 0.005% (the quadrupole is scanned with a duty cycle of approximately 0.1% and the time of flight analyser acts a mass filter with a duty cycle of approximately 5%). Once candidate parent ions have been discovered, a daughter ion spectrum of a candidate parent ion can be obtained with an duty cycle of 5% (the quadrupole acts as a mass filter with a duty cycle of approximately 100% and the time of flight analyser is scanned with a duty cycle of 5%). The resultant duty cycle therefore of discovering a number of candidate parent ions and producing a daughter spectrum of one of the candidate parent ions is approximately 0.005% (since 0.005%<<5%).

As can be seen, a triple quadrupole has approximately an order higher duty cycle than a quadrupole-time of flight mass spectrometer for performing conventional methods of parent ion scanning and obtaining confirmatory daughter ion spectra of discovered candidate parent ions. However, such duty cycles are not high enough to be used practically and efficiently for analysing real time data which is required when the source of ions is the eluent from a chromatography device.

Electrospray and laser desorption techniques have made it possible to generate molecular ions having very high molecular weights, and time of flight mass analysers are advantageous for the analysis of such large mass biomolecules by virtue of their high efficiency at recording a full mass spectrum. They also have a high resolution and mass accuracy.

Other forms of mass analysers such as quadrupole ion traps are similar in some ways to time of flight analysers, in that like time of flight analysers, they can not provide a continuous output and hence have a low efficiency if used as a mass filter to continuously transmit ions which is an important feature of the conventional methods of parent ion scanning. Both time of flight mass analysers and quadrupole ion traps may be termed "discontinuous output mass analysers".

It is therefore desired to provide improved methods and apparatus for mass spectrometry, and according to a preferred embodiment to provide improved methods and apparatus which can identify candidate parent ions faster than conventional methods which would be suitable for use in chromatography applications on a real time basis.

SUMMARY OF THE INVENTION

According to a first embodiment and first aspect of the present invention, the first step of discovering candidate parent ions can be performed with a duty cycle of 2.5% (the quadrupole mass filter has a duty cycle of 100% and the time of flight analyser has a duty cycle of 5%, but two experimental runs need to be performed, one with the collision cell operated in a high fragmentation mode and the other with the collision cell operated in a low fragmentation mode, thereby halving the resultant duty cycle from 5% to 2.5%). The second step of confirming the identity of a particular candidate parent ion by performing a full daughter spectrum of the candidate parent ion can be performed with a duty cycle of 5% (the quadrupole again operates as a mass filter with approximately 100% duty cycle and the time of flight analyser acts as an analyser with a duty cycle of approximately 5%). Accordingly, only three experimental runs are required in order to discover a number of candidate parent ions and to produce a daughter ion spectrum of one of the candidate parent ions, each experimental run having a duty cycle of 5%. The resultant overall duty cycle is therefore 5%/3=1.67%.

The preferred embodiment therefore has a duty cycle which is approximately 30 times better than that of the conventional method performed on a triple quadrupole arrangement, and shows an improvement greater than 300 times compared with the conventional method performed on a quadrupole-time of flight mass spectrometer. Such an improvement enables the apparatus and method according to the preferred embodiment to used effectively at on-line chromatography time scales.

When the fragmentation means is operated in the first mode, a high voltage is applied to the fragmentation means which causes the ions passing therethrough to fragment. However, when the fragmentation means is operated in the second mode then the ions are substantially less fragmented and there is a higher proportion of molecular ions which are transmitted therethrough.

Preferably, operating the fragmentation means in the first mode comprises the step of supplying a voltage to the fragmentation means selected from the group comprising: (i) ≧15V; (ii) ≧20V; (iii) ≧25V; (iv) ≧30V; (v) ≧50V; (vi) ≧100V; (vii) ≧150V; and (viii) ≧200V. Preferably, operating the fragmentation means in the second mode comprises the step of supplying a voltage to the fragmentation means selected from the group comprising: (i) ≦5V; (ii) ≦4.5V; (iii) ≦4V; (iv) ≦3.5V; (v) ≦3V; (vi) ≦2.5V; (vii) ≦2V; (viii) ≦1.5V; (ix) ≦1V; (x) ≦0.5V; and (xi) substantially OV. However, according to less preferred arrangements for both the first and second embodiments of the present invention, a voltage between 5V and 15V could be used for the first mode and/or the second mode. In such circumstances it would be expected that a proportion of the ions in the high energy mode would not actually be fragmented and similarly, in the low energy mode, a proportion of the ions would be fragmented.

In order to filter the ions, a first mass filter upstream of a fragmentation means, e.g. a collision cell, is preferably arranged so that only ions having a mass-to-charge ratio (hereinafter "m/z") greater than a certain m/z are transmitted i.e. according to a preferred embodiment the first mass filter is initially set to operate as a high pass filter. The cutoff point may be set so that it is a little higher than the m/z value of the characteristic daughter ion which is being monitored for. For example, if the characteristic daughter ion is known to have a m/z value of 300, then the first mass filter may be set to only transmit ions having a m/z greater than say 350. Therefore, if an ion having a m/z value of 300 is subsequently detected by the mass analyser, then it follows that the ion must be a daughter ion caused by fragmentation of a parent ion in the fragmentation means since parent ions having this m/z would be filtered out by the first mass filter.

Preferably, the first range is variable. The range of ions transmitted by the first mass filter can therefore be altered every scan if necessary.

Preferably, the step of mass analysing at least some of the ions which have passed through the fragmentation means operating in the first mode comprises obtaining a first mass spectrum and wherein the step of mass analysing at least some of the ions which have passed through the fragmentation means operating in the second mode comprises obtaining a second mass spectrum.

Preferably, after the step of mass analysing at least some of the ions which have been passed through the fragmentation means operating in the second mode, the method further comprises the step of identifying at least one candidate parent ion. The at least one candidate parent ion is preferably identified by comparing the intensity of ions having a certain mass-to-charge ratio in the first mass spectrum with the intensity of ions having the same mass-to-charge ratio in the second mass spectrum. If a high intensity peak is found in the low energy spectrum but not in the high energy spectrum then it is likely that the peak represents a candidate parent ion.

Preferably, the method further comprises the steps of: filtering the ions upstream of the fragmentation means so that ions having a mass-to-charge ratio within a second range which includes at least one candidate parent ion are arranged to be substantially transmitted to the fragmentation means and so that the transmission of ions having a mass-to-charge ratio outside of the second range is substantially reduced; operating the fragmentation means so that substantially more of the ions are fragmented than in the second mode; and then mass analysing at least some of the ions which have passed through the fragmentation means. In otherwords, once a candidate parent ion has been identified, then the first mass filter is preferably set to operate as a narrow bandpass filter substantially only allowing ions at the m/z value of a particular candidate parent ion to be transmitted. According to a preferred embodiment, the second range is selected so that only ions having mass-to-charge ratios within ±x mass-to-charge units of a candidate parent ion are substantially transmitted to the fragmentation means (4), wherein x is selected from the group comprising: (i) 0.5; (ii) 1.0; (iii) 2.0; (iv) 5.0; (v) 10.0; (vi) 15.0; and (vii) 20.0. The mass spectrometer therefore operates in a tandem MS mode.

Preferably, the ion source is selected from the group comprising: (i) an electrospray ion source; (ii) an atmospheric pressure chemical ionization ion source; and (iii) a matrix assisted laser desorption ion source. Such ion sources, especially the first two, may be provided with an eluent over a period of time, the eluent having been separated from a mixture by means of liquid chromatography.

Preferably, the ion source is selected from the group comprising: (i) an electron impact ion source; (ii) a chemical ionization ion source; and (iii) a field ionisation ion source. Such ion sources may be provided with an eluent over a period of time, the eluent having been separated from a mixture by means of gas chromatography.

Preferably, the mass analysing steps are performed by an analyser selected from the group comprising: (i) a quadrupole mass filter; (ii) a time-of-flight mass analyser; (iii) an ion trap; (iv) a magnetic sector analyser; and (v) a Fourier Transform Ion Cyclotron Resonance ("FTICR") mass analyser. A time-of-flight mass analyser is particularly preferred.

Preferably, the filtering step(s) are performed by a multi-element ion optical lens, preferably a quadrupole rod set, which is further preferably provided with both a RF and a DC electric field.

Preferably, the multi-element ion optical lens is arranged to substantially transmit only ions having mass-to-charge ratios greater than a first value. Further preferably, the first value is selected from the group comprising: (i) 100; (ii) 150; (iii) 200; (iv) 250; (v) 300; (vi) 350; (vii) 400; (viii) 450; and (ix) 500. The step of identifying daughter ions in a preferred embodiment comprises identifying at least some ions which are determined to have mass-to-charge ratios less than the first value.

Preferably, the fragmentation means comprises a collision cell selected from the group comprising: (i) a quadrupole rod set; (ii) an hexapole rod set; (iii) an octopole rod set; and (iv) an electrode ring set. Further preferably, the collision cell is operated in a RF only mode and in a preferred arrangement is provided with a collision gas at a pressure within the range $10^{-4}$ to $10^{-1}$ mbar, preferably $10^{-3}$ to $10^{-2}$ mbar. Further preferably, the collision cell forms a substantially gas-tight enclosure. The collision gas may preferably comprise helium, argon, nitrogen, air or methane.

Preferably, the predetermined daughter ions comprises ions selected from the group comprising: (i) immonium ions from peptides; (ii) functional groups which includes, for example, phosphate group $PO_3^-$ ions from phosphorylated peptides; and (iii) mass tags which are intended to cleave from a specific molecule or class of molecule and to be subsequently identified thus reporting the presence of the specific molecule or class of molecule.

According to a preferred embodiment it is possible to search for candidate parent ions by interrogating the high collision energy MS spectrum (i.e. daughter ion spectrum) for more than one characteristic daughter ion. This may be particularly relevant when the parent ions have been "tagged" with a specific mass tag. A mixture of two or more parent ions may be tagged each with a different mass tag and which could be discovered by simultaneously monitoring for two or more characteristic daughter ions. Hence, parent ions from two or more different classes of compounds could be discovered in the same set of experiments.

The implementation of the various steps by a control system, preferably on automatic control system, is merely a preferred feature. In a less preferred embodiment some of the method steps could involve human interaction from an operator.

Whereas in the first embodiment, the fragmentation means was operated in the second mode (where there was a lesser degree of fragmentation) only once a daughter ion of interest had been identified, according to the second embodiment the fragmentation means preferably switches back and forth between the high and low energy modes i.e. a parent ion spectrum may be obtained without having first determined (or irrespective of) whether, for example, a predetermined daughter ion has been determined to be present.

Three different modes of operation (or sub-embodiments) are contemplated by the second embodiment. In a first mode of operation it is only necessary to determine whether a predetermined daughter ion is present in the daughter ion spectrum. In this particular mode it is not strictly necessary for a candidate parent ion to have first been identified, although this is preferable. In a second mode of operation it is determined whether there could be some connection between at least one daughter ion and at least one candidate parent ion by virtue of the loss of a predetermined ion (such as, for example, a functional group) or the loss of a neutral particle. A third mode of operation is also contemplated in which the determining steps of both the first and second modes of operation may be performed.

Preferably, the method further comprises the step of filtering the ions upstream of the fragmentation means so that ions having a mass-to-charge ratio within a first range are substantially transmitted and so that the transmission of ions having a mass-to-charge ratio outside of the first range is substantially reduced.

Preferably, the first range is variable and hence may be altered each scan.

Preferably, the step of identifying at least one daughter ion comprises determining at least some ions which have a mass-to-charge ratio which falls outside of the first range. According to the second embodiment, identifying a daughter ion on the basis of the daughter ion having a m/z lower than the cut-off value of a first mass filter is only one way of identifying a daughter ion. Other ways of identifying a daughter ion are also contemplated.

Preferably, the step of mass analysing at least some of the ions which have passed through the fragmentation means operating in the first mode comprises obtaining a first mass spectrum and wherein the step of mass analysing at least some of the ions which have passed through the fragmentation means operating in the second mode comprises obtaining a second mass spectrum.

Preferably, the at least one candidate parent ion is identified by comparing the intensity of ions having a certain mass-to-charge ratio in the first (daughter ion) mass spectrum with the intensity of ions having the same mass-to-charge ratio in the second (parent ion) mass spectrum. Preferably, the at least one daughter ion is identified by comparing the intensity of ions having a certain mass-to-charge ratio in the first mass spectrum with the intensity of ions having the same mass-to-charge ratio in the second mass spectrum. A candidate parent ion will preferably have a much higher intensity in said second mass spectrum compared with said first spectrum (and vice versa for a daughter ion).

Preferably, if it is determined that: (i) the at least one daughter ion corresponds with a predetermined daughter ion; and/or (ii) the at least one daughter ion and the at least one candidate parent ion could be related by the loss of a predetermined ion or neutral particle, then the method further comprises the steps of: filtering the ions upstream of fragmentation means so that ions having a mass-to-charge ratio within a second range which includes at least one candidate parent ion are arranged to be substantially transmitted to the fragmentation means and so that the transmission of ions having a mass-to-charge ratio outside of the second range is substantially reduced; operating the fragmentation means so that substantially more of the ions are fragmented than in the second mode; and mass analysing at least some of the ions which have passed through the fragmentation means. In other words once a daughter ion of interest or an interesting connection or relationship between a parent ion and a daughter ion has been established, then the mass spectrometer switches to operate in a tandem MS mode.

Preferably, the second range is selected so that only ions having mass-to-charge ratios within ±x mass-to-charge units of a candidate parent ion are substantially transmitted to the fragmentation means, wherein x is selected from the group comprising: (i) 0.5; (ii) 1.0; (iii) 2.0; (iv) 5.0; (v) 10.0; (vi) 15.0; and (vii) 20.0. The mass filter upstream of the collision cell therefore preferably operates as a narrow bandpass filter.

Preferably, the ion source is selected from the group comprising: (i) an electrospray ion source; (ii) an atmospheric pressure chemical ionization ion source; and (iii) a matrix assisted laser desorption ion source. Preferably, such an ion source, especially the first two, is provided with an eluent over a period of time, the eluent having been separated from a mixture by means of liquid chromatography.

Preferably, the ion source is selected from the group comprising: (i) an electron impact ion source; (ii) a chemical ionization ion source; and (iii) a field ionisation ion source. Preferably, such an ion source is provided with an eluent over a period of time, the eluent having been separated from a mixture by means of gas chromatography.

Preferably, the mass analysing steps are performed by an analyser selected from the group comprising: (i) a quadrupole rod set; (ii) a time-of-flight mass analyser; (iii) an ion trap; (iv) a magnetic sector analyser; and (v) a Fourier Transform Ion Cyclotron Resonance ("FTICR") mass analyser. A time-of-flight mass analyser is particularly preferred.

Preferably, the filtering step(s) are performed by a multi-element ion optical lens, preferably a quadrupole mass filter. Further preferably, both a RF and a DC electric field are applied to the multi-element ion optical lens.

Preferably, the multi-element ion optical lens is arranged to substantially transmit only ions having mass-to-charge ratios greater than a first value. Further preferably, the first value is selected from the group comprising: (i) 100; (ii) 150; (iii) 200; (iv) 250; (v) 300; (vi) 350; (vii) 400; (viii) 450; and (ix) 500. Preferably, the step of identifying daughter ions comprises identifying at least some ions which are determined to have mass-to-charge ratios less than the first value.

Preferably, the fragmentation means comprises a collision cell selected from the group comprising: (i) a quadrupole rod set; (ii) an hexapole rod set; (iii) an octopole rod set; and (iv) an electrode ring set. Preferably, the collision cell is operated in a RF only mode, and is further preferably provided with a collision gas at a pressure within the range $10^{-3}$ to $10^{-1}$ mbar, preferably $10^{-3}$ to $10^{-2}$ mbar. Preferably, the collision cell forms a substantially gas-tight enclosure.

Preferably, the predetermined daughter ions comprises ions selected from the group comprising: (i) immonium ions from peptides; (ii) functional groups including phosphate group $PO_3^-$ ions from phosphorylated peptides; and (iii) mass tags which are intended to cleave from a specific molecule or class of molecule and to be subsequently identified thus reporting the presence of the specific molecule or class of molecule.

Preferably, operating the fragmentation means in the first mode comprises the step of supplying a voltage to the fragmentation means selected from the group comprising: (i) ≧15V; (ii) ≧20V; (iii) ≧25V; (iv) ≧30V; (v) ≧50V; (vi) ≧100V; (vii) ≧150V; and (viii) ≧200V.

Preferably, operating the fragmentation means in the second mode comprises the step of supplying a voltage to the fragmentation means selected from the group comprising: (i) ≦5V; (ii) ≦4.5V; (iii) ≦4V; (iv) ≦3.5V; (v) ≦3V; (vi) ≦2.5V; (vii) ≦2V; (viii) ≦1.5V; (ix) ≦1V; (x) ≦0.5V; and (xi) substantially OV.

Although it is preferred in the first embodiment (and optionally in the second embodiment) for the quadrupole mass filter to have initially a high pass characteristic, in less preferred embodiments the mass filter may have a bandpass characteristic. It is also contemplated in less preferred embodiments that the mass filter could have a "V-notched" transmission profile i.e. high transmission at low and high mass-to-charge ratios and preferably linearly or otherwise rapidly decreasing/increasing transmission either side of a mid-point.

The implementation of alternating low and high collision energy in both the first and second embodiments allows for (candidate) parent ions to be selected based on the occurrence of a specific daughter ion m/z value, either nominal or exact, in the high collision energy "MS survey" spectrum. According to the second embodiment, the selection criteria may also include selection based on the occurrence of ions with a specific difference in m/z value, either nominal or exact, between those in the low and high collision energy "MS survey" spectra.

Once one or more parent ions have been discovered, then according to both embodiments, a number of further criteria may be used for the further selection and/or rejection of candidate parent ions i.e. to refine the list of possible candidate parent ions down to a shortlist of more definite candidate parent ions. These criteria include:

(a) selection based on required charge state (typically Z>1 for peptides, Z=1 for drug metabolites);

(b) selection based on relative or absolute intensity;

(c) selection based on inclusion within a preferred m/z range;

(d) selection based on list of preferred m/z values, either nominal or exact;

(e) rejection based on list of excluded m/z values, either nominal or exact (typically known background ions or matrix related impurities);

(f) rejection based on temporary (dynamic) list of excluded m/z values (typically precursor ions that have recently been analysed to prevent duplication).

According to the second embodiment and as a less preferred feature of the first embodiment, daughter ions formed by the fragmentation of multiply charged parent ions may be detected by the presence of ions having mass-to-charge ratios higher than the mass-to-charge ratios of candidate parent ions. This may be particularly appropriate when parent ions are generated by electrospray.

According to the first and second embodiment, in the event of multiple co-eluting components the true precursor ion may be discovered by using the first mass filter, MS1, to select each candidate precursor ion in turn to record its MS/MS fragment spectrum. However, the number of spectra to be acquired will only be increased by a number equal to just the number of candidate precursor ions. This is still much less than the many hundreds of spectra required by traditional parent ion scanning methods.

In the case of multiple co-eluting components there is scope for reducing the number of candidate precursor ions by the use of additional filtering criteria. For example, the targeted precursor ion may be discovered if the high collision energy spectrum is also interrogated for the presence of one or more characteristic neutral loss ions corresponding to each of the candidate precursor ions observed in the low collision energy spectrum. This may reduce the number of MS/MS fragment spectra to be recorded, in many cases to just one spectrum.

In principal, if the number of candidate precursor ions is four or more the number of MS/MS spectra to be acquired could be further reduced by repeatedly sub-dividing the candidate precursors in two equal or near equal sub-groups according to their mass. The high collision energy spectrum for all the precursor ions within each sub-group would then be recorded by setting the low-mass cut-off for MS1 to a m/z value dividing the two groups. By a process of elimination this procedure would allow arrival at the targeted precursor ion in less stages. In practice, this approach is preferred only when the number of candidate precursor ions is six or more. Nevertheless, to illustrate the potential value of this method, a mixture of 16 components may require 16 MS/MS spectra to discover the target precursor ion, whereas this approach could reduce the required number of MS/MS spectra to five.

Precursor ion discovery based on the presence of a specific product ion m/z value requires initial interrogation of only the high energy CID (Collision Induced Decomposition) "MS survey" spectra. If appropriate, the m/z transmission range of the quadrupole mass filter may be set such as not to transmit the m/z value of the specified product ion, thereby removing any background ions from the source at that m/z value. Any ions at the specified m/z value can only be product ions. When a daughter ion of interest elutes, the low energy CID "MS survey" spectrum now yields a short list of (candidate) parent ions. This list may optionally be further filtered or refined by various selection and/or rejection criteria, such as charge state, excluded m/z values, etc. Confirmation and identification of the targeted precursor ion now only requires acquisition of MS—MS spectra for the (optionally further filtered) short list of candidates. This achieves the same goal as traditional parent ion scanning without the need to scan the first mass filter, MS1, and with the added bonus of having acquired the full daugher ion spectrum of the targeted precursor ion. Specification of exact product ion m/z values further enhances selectivity.

Precursor Ion Discovery based on the presence of a specific neutral or ion loss requires interrogation of both the low and high energy CID "MS survey" spectra. The low energy spectra yield a short list of candidate precursor ions. Again this short list may be further filtered by various criteria, i.e. charge state, excluded m/z values, etc. A short list of m/z values with the specified neutral or ion loss may now be generated. These m/z values are now searched against the high energy CID "MS survey" spectrum. The precursor ion for any hits may be confirmed and identified by acquisition of its MS—MS spectrum. This achieves the same goal as traditional neutral loss scanning without the need to scan MS1 and MS2, and again with the added bonus of having acquired the full product ion spectrum of the targeted precursor ion. Again exact m/z values may be specified.

The various preferred embodiments provide numerous advantages over conventional techniques of parent ion scanning, including the possibility of discovering the mass-to-charge ratios of parent ions and to obtain their corresponding daughter ion spectra within on-line time scales e.g. chromatography time scales. The preferred embodiments also have higher sensitivities than conventional parent ion scanning methods, and open up the possibility of incorporating multiple criteria into the same experiment for selection of parent ion m/z values. It is also possible to discover multiple classes of parent ion within the same experiment and the methods can be used with mass tagging.

BRIEF DESCRIPTION OF THE DRAWINGS

Various embodiments of the present invention will now be described, by way of example only, and with reference to the accompanying drawings in which.

DETAILED DESCRIPTION OF PREFERRED EMBODIMENTS

Figure 1:
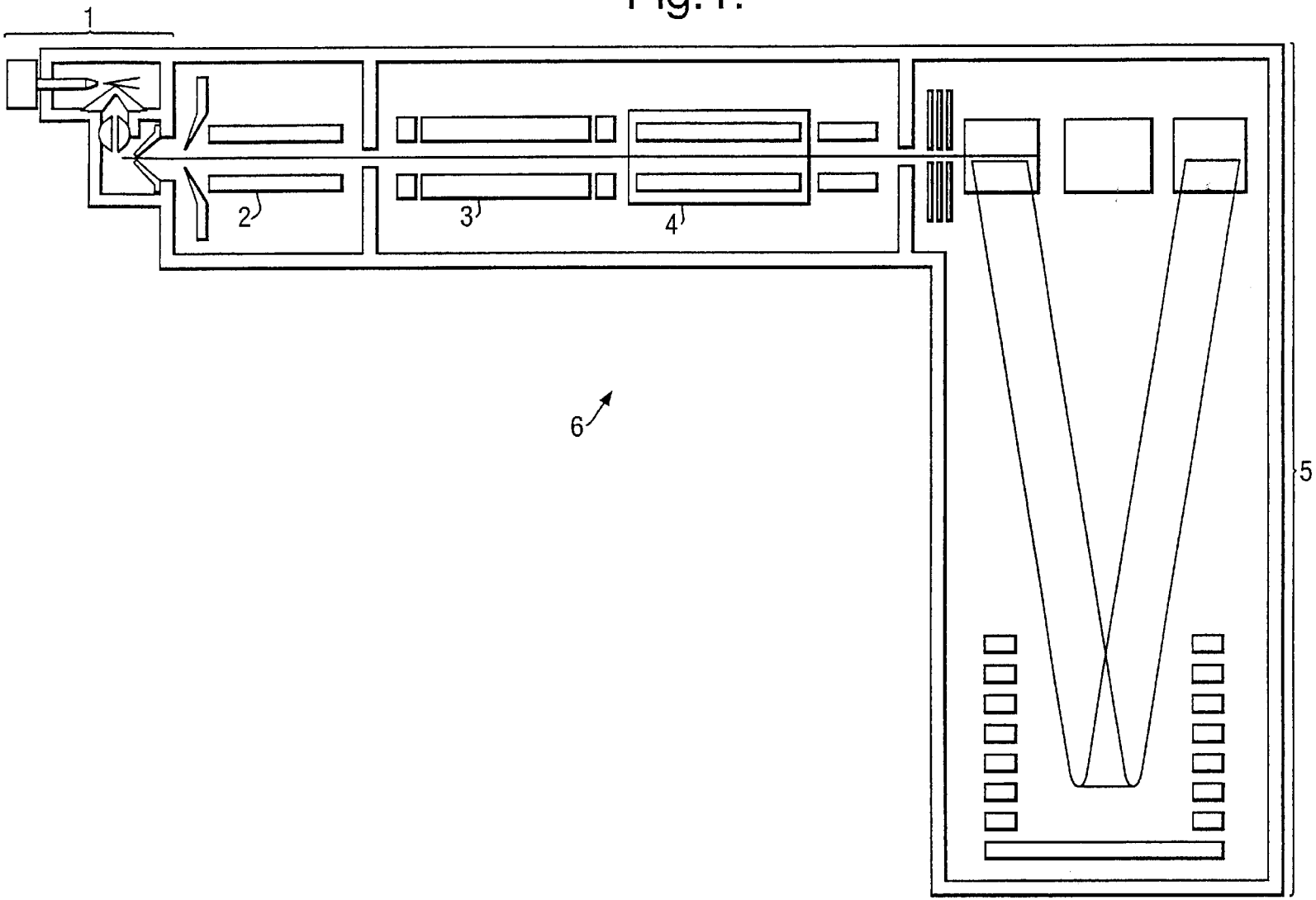
FIG. 1 is a schematic drawing of a preferred arrangement.

A preferred embodiment will now be described with reference to FIG. 1. A mass spectrometer 6 comprises an ion source 1, preferably an electrospray ionization source, an optional ion guide 2, a first quadrupole mass filter 3, a collision cell 4 and an orthogonal acceleration time-of-flight mass analyser incorporating a reflectron 5. The mass spectrometer 6 may be interfaced with a chromatograph, such as a liquid chromatograph (not shown), so that the sample entering the ion source 1 may be taken from the eluent of the liquid chromatograph.

The quadrupole mass filter 3 is disposed in an evacuated chamber which is maintained at a relatively low pressure e.g. less than $10^{-5}$ mbar. The electrodes comprising the mass filter 3 are connected to a power supply which generates both RF and DC potentials which determine the range of mass-to-charge values that are transmitted by the filter 3. A fragmentation means 4, preferably a collision cell, is disposed to receive ions which are transmitted by the mass filter 3. In particularly preferred embodiments the collision cell may comprise a quadrupole or hexapole rod set which may be enclosed by a substantially gas-tight casing into which a collision gas, in use, such as helium, argon, nitrogen, air or methane may be introduced at a pressure of between $10^{-4}$ and $10^{-1}$ mbar, further preferably $10^{-3}$ mbar to $10^{-2}$ mbar. Suitable RF potentials for the electrodes comprising the fragmentation means 4 are provided by a power supply (not shown).

Ions generated by the ion source 1 pass through the ion guide 2 into the mass filter 3 and into the fragmentation means 4. Ions exiting from the fragmentation means 4 pass into a time-of-flight mass analyser 5. Other ion optical components, such as ion guides or electrostatic lenses, may be present which are not shown in the figures or described herein to maximise ion transmission between various parts of the apparatus. Various vacuum pumps (not shown) may be provided for maintaining optimal vacuum conditions in the device. The time-of-flight mass analyser 5 operates in a known way by measuring the transit time of the ions comprised in a packet of ions so that their mass-to-charge ratios can be determined.

A control means (not shown) provides control signals for the various power supplies (not shown) which respectively provide the necessary operating potentials for the ion source 1, ion guide 2, quadrupole mass filter 3, fragmentation means 4 and the time-of-flight mass analyser 5. These control signals determine the operating parameters of the instrument, for example the mass-to-charge ratios transmitted through the mass filter 3 and the operation of the analyser 5. The control means is typically controlled by signals from a computer (not shown) which may also be used to process the mass spectral data acquired. The computer can also display and store mass spectra produced from the analyser 5 and receive and process commands from an operator. The control means may be automatically set to perform various methods and make various determinations without operator intervention, or may optionally require operator input at various stages.

Figure 2A:
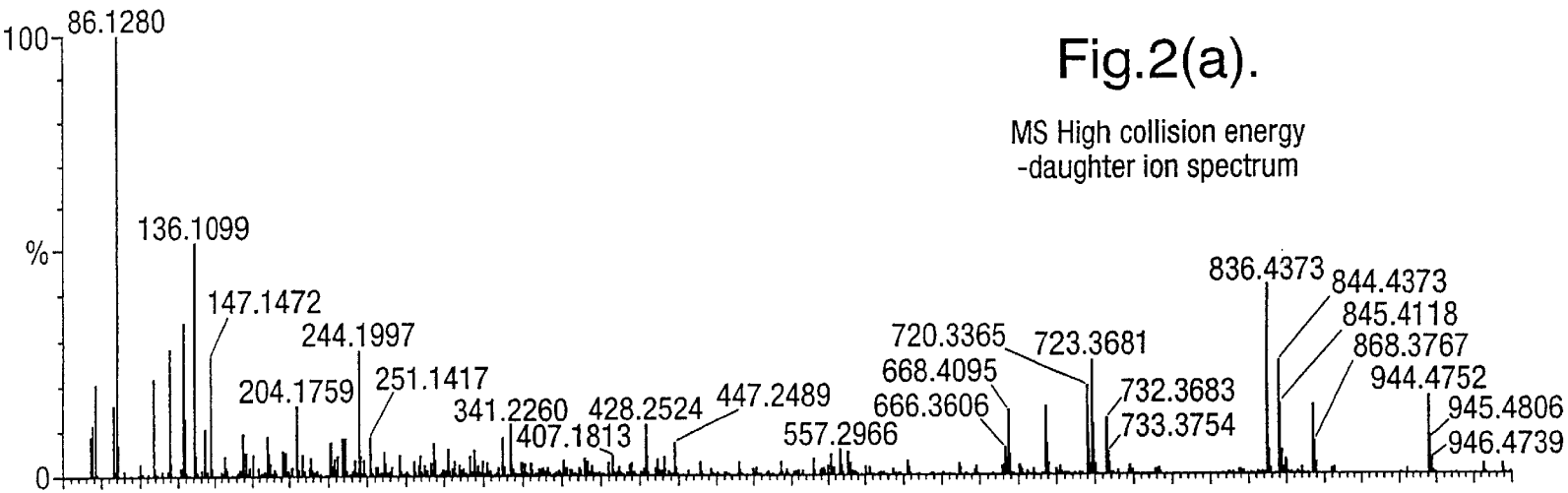
FIGS. 2(*a*) and 2(*b*) respectively show typical daughter ion and parent ion spectra.
Figure 2B:
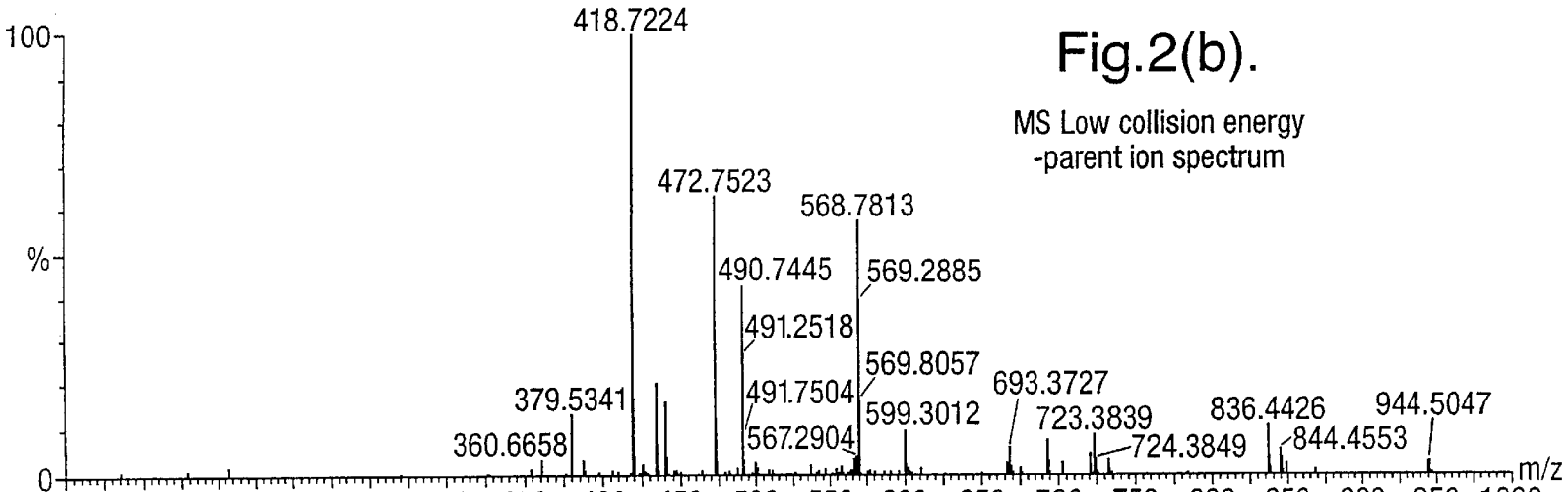

FIGS. 2(*a*) and 2(*b*) show respectively daughter and parent ion spectra of a tryptic digest of ADH known as alcohol dehydrogenase. The daughter ion spectrum shown in FIG. 2(*a*) was obtained while the collision cell voltage (i.e. the voltage applied to fragmentation means 4) was high, e.g. 30V, which resulted in significant fragmentation of ions passing therethrough. The parent ion spectrum shown in FIG. 2(*b*) was obtained at low collision energy e.g. $\leqq$5V. The mass spectra in this particular example were obtained from a sample eluting from a liquid chromatograph, and the spectra were obtained sufficiently rapidly and close together in time that they correspond to substantially the same component or components eluting from the liquid chromatograph.

According to both embodiments of the present invention, it may be determined that a predetermined daughter ion of interest say, for example, daughter ions having a m/z value of 136.1099 as shown in FIG. 2(*a*) are present. This determination may be made either by an operator or by automatic determination using a computer. According to the first embodiment once this determination has been made, then the voltage applied to the collision cell is set to low and a parent ion spectrum (corresponding to FIG. 2(*b*)) is acquired.

In both embodiments, the parent ion spectrum may then be analysed so as to determine which peaks correspond to candidate parent ions. In FIG. 2(*b*), there are several high intensity peaks in the parent ion spectrum, e.g. the peaks at 418.7724 and 568.7813, which are not substantially present in the corresponding daughter ion spectrum. These peaks may therefore preferably be considered to indicate candidate parent ions.

According to both embodiments, once a predetermined daughter ion of interest has been detected, for example, ions having a m/z value of 136.1099, and corresponding candidate parent ion(s) have been identified, e.g. ions having m/z values of 418.7724 and 568.7813, then the mass filter 3 is set to operate as a narrow band pass filter so as to substantially transmit to the fragmentation means 4 only one of the candidate parent ions, for example, ions having a m/z value of 418.7224. The fragmentation means 4 is set at high collision energy, so that a full daughter spectrum for that particular candidate parent ion may be obtained. If the predetermined daughter ion of interest is present in the full daughter spectrum, then it must be a product of the selected candidate parent ion. If the predetermined daughter ion is not present then another candidate parent ion is selected.

Even if a daughter ion scan is required to be run for all candidate parent ion peaks, much fewer scans are required than in the conventional methods of parent ion scanning.

Variables which may be taken into account in determining whether particular peaks are significant may include e.g. the intensity of the observed peak or the charge state of the ion (which may be deduced by a variety of known methods). Ions may also be excluded from consideration based on certain criteria.

In relation to both embodiments of the present invention, it may be appropriate to search for candidate parent ions by interrogating the daughter ion spectrum for more than one characteristic daughter ion.

According to the second embodiment of the present invention, candidate parent ions may be searched for on the basis of a combination of daughter ions and the loss of predetermined ions or neutral particles from a parent ion. This may be particularly relevant when the parent ions have been "tagged" with a specific mass tag. A mixture of two or more parent ions may be tagged each with a different mass tag which could be discovered by simultaneously monitoring for two or more characteristic daughter ions. Hence, parent ions from two or more different classes of compounds could be discovered in the same set of experiments.

According to the second embodiment spectra may be continuously acquired at different collision voltages. A particularly preferred arrangement is to acquire spectra alternately at relatively high and low collision voltages. When the method is used to analyse the output of an on-line process such as liquid chromatography, this method is particularly useful as alternate spectra correspond to substantially the same composition of sample eluting from the chromatograph.

A number of examples will now be given to further illustrate various aspects of preferred embodiments of the present invention.

EXAMPLE 1

Neutral Loss

The huge increase in genomic sequence information available, combined with the increased sensitivity and selectivity provided by mass spectrometry has allowed large-scale protein identification. The analysis of the post-translational modifications present on the identified proteins is, however, a more challenging problem. Currently the approach that offers the most specific solution, via mass spectrometry, is precursor ion scanning. When performing a precursor ion scanning experiment the mass spectrometer searches for all ions that fragment to produce a common diagnostic product ion. A typical application would be to scan through a protein digest mixture searching only for those peptides that are potentially phosphorylated. Current methods of performing precursor ion experiments on a known mass spectrometer (Q-TOF 2 available from Micromass) having a first quadrupole mass filter (MS1), a quadrupole collision cell and an orthogonal time of flight mass analyser (MS2) involve scanning the quadrupole of the instrument, MS1, over the m/z range in which precursors are sought, whilst recording a full product ion spectrum with the time of flight analyser. This approach can, however, limit the sensitivity of the precursor ion experiment due to the relatively low duty cycle of a scanning quadrupole.

An experimental methodology that allows specific post translationally modified peptides to be identified and sequenced during the course of an HPLC experiment on the known mass spectrometer will now be described. During this experiment the quadrupole was operated in wideband mode.

Figure 3:
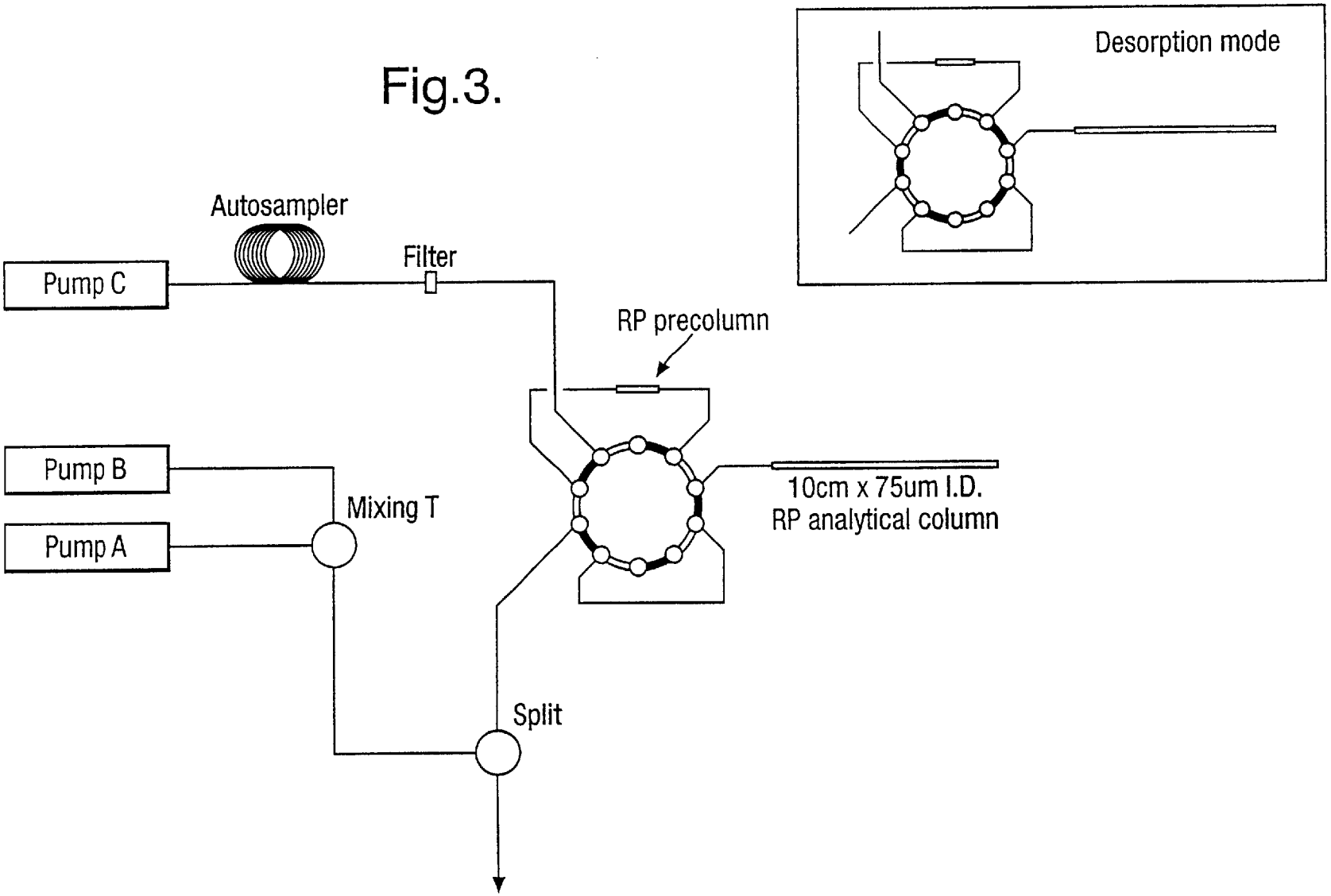
FIG. 3 shows a schematic of a valve switching arrangement during sample loading and desalting. Inset shows desorption of a sample from an analytical column.

The samples were introduced to the mass spectrometer by means of a Micromass modular CapLC system. Samples were loaded onto a C18 cartridge (0.3 mm×5 mm) and desalted with 0.1% HCOOH for 3 minutes at a flow rate of 30 $\mu$L per minute (FIG. 3). The ten port valve was then switched such that the peptides were eluted onto the analytical column for separation, see insert FIG. 3. The flow from pumps A and B were split to produce a flow rate through the column of approximately 200 nL/min.

The analytical column used was a PicoFrit™ (www.newobjective.com) column packed with Waters Symmetry C18 (www.waters.com). This was set up to spray directly into the mass spectrometer. The electrospray potential (ca. 3 kV) was applied to the liquid via a low dead volume stainless steel union. A small amount (ca. 5 psi) of nebulising gas was introduced around the spray tip to aid the electrospray process.

All data were acquired using a Q-TOF2 quadrupole orthogonal acceleration time-of-flight hybrid mass spectrometer (www.micromass.co.uk), fitted with a Z-spray nanoflow electrospray ion source. The mass spectrometer was operated in the positive ion mode with a source temperature of 80° C. and a cone gas flow rate of 40 L/hr.

The instrument was calibrated with a multi-point calibration using selected fragment ions that resulted from the collision-induced decomposition (CID) of Glu-fibrinopeptide b. All data were processed using the MassLynx suite of software.

Figure 4:
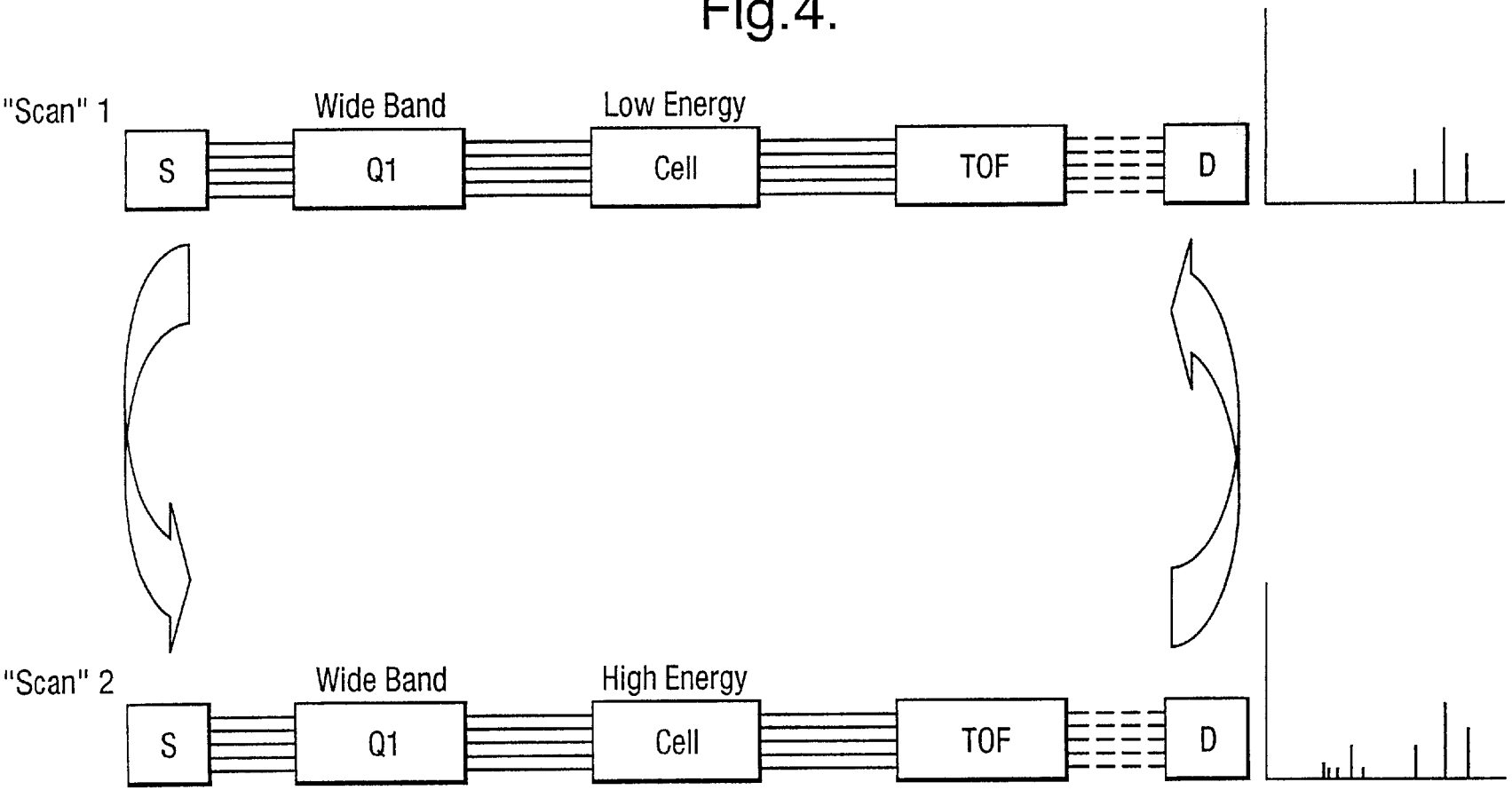
FIG. 4 shows a Q-TOF2 mass spectrometer switching, preferably, at one second intervals, between low and high collision energy with argon gas in the collision cell. The low energy data set shows the pseudo molecular ions, and the high energy data set also shows their fragment ions.

During the HPLC gradient the instrument was operated in the MS mode and switched alternately at one-second intervals between low and high collision energy with argon in the collision cell. The quadrupole, MS1, was operated in the rf only mode allowing the full mass range to be passed to the time of flight analyser. The first data set at low energy (4 eV) shows only the normal pseudo molecular ions. The second at higher energy also contains their product ions (see FIG. 4). Whenever a product ion of interest occurred in the high-energy data, all its possible precursors were present in the corresponding low energy data. The mass spectrometer was then switched to a MS/MS mode sequentially selecting the potential precursors to reveal the true parent.

Figure 5:
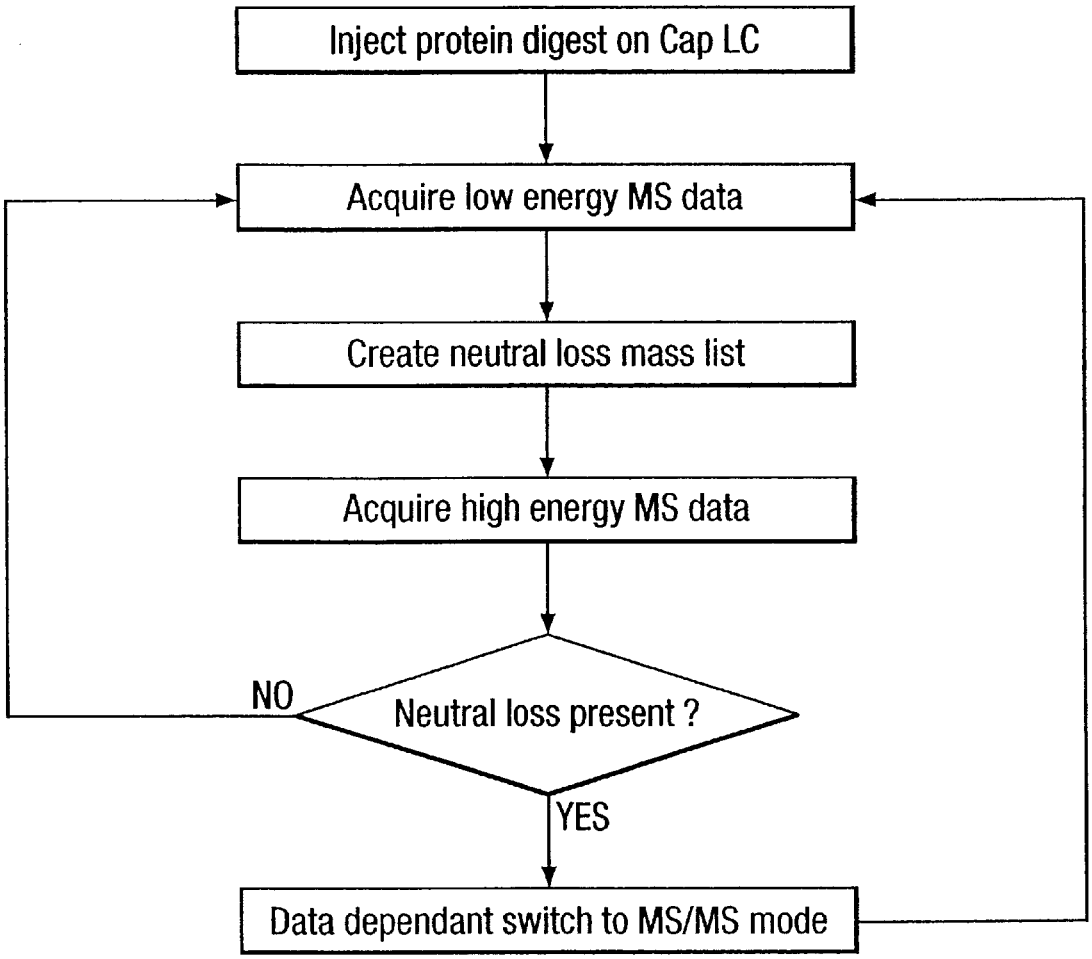
FIG. 5 shows a flow chart of an exact neutral loss experiment.

In the case of phosphopeptides, both phosphoserine and phosphothreonine containing precursors may be identified as they display a neutral loss of 98 Da ($H_3PO_4$) under high-energy conditions. Correspondingly, the software may make a list of neutral losses from the precursors identified in the low energy spectrum. This involves measuring the masses of the precursor ions, determining their charge states and subtracting the neutral loss i.e. 97.9769 (1+), 49.9885 (2+). Appearance of the neutral loss in the high energy spectrum causes the instrument to switch into the product ion mode to confirm the neutral loss and to acquire additional sequence information. The exact mass capability of the Q-TOF2 increases the specificity of the neutral loss particularly in the case of a mass deficient loss such as that observed with phosphate. FIG. 5 shows a schematic of an exact neutral loss experiment.

Figure 6:
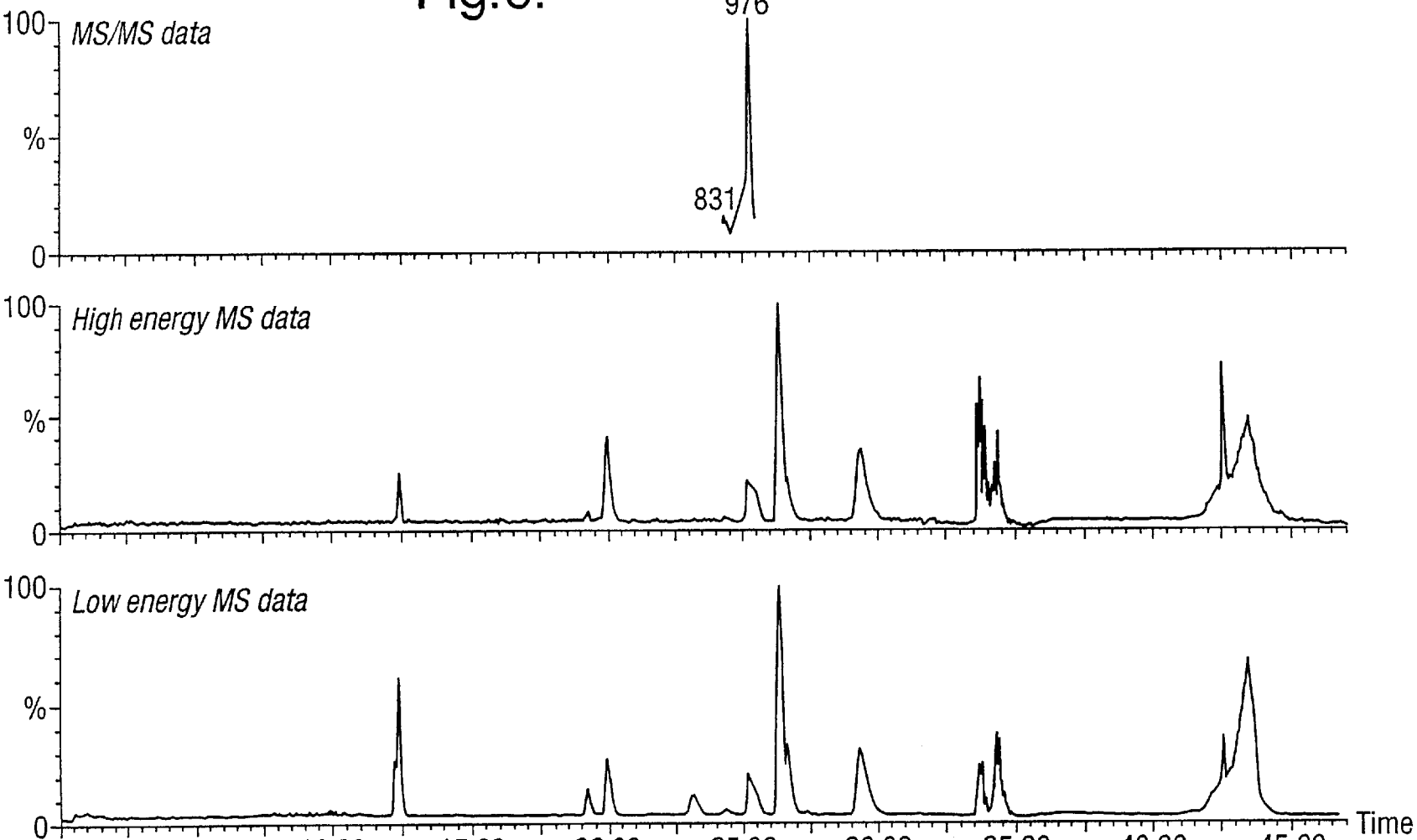
FIG. 6 shows results of an exact neutral loss experiment on 100 fm of an alpha casein digest loaded onto a column.

FIG. 6 shows the results of an exact neutral loss experiment performed on 100 fm of an alpha casein digest loaded on column. As can be seen from the MS/MS chromatogram the instrument switched to the product ion mode twice during the experiment, suggesting that the 830.02 (2+) and 976.46 (2+) ions have exhibited a neutral loss.

Figure 7:
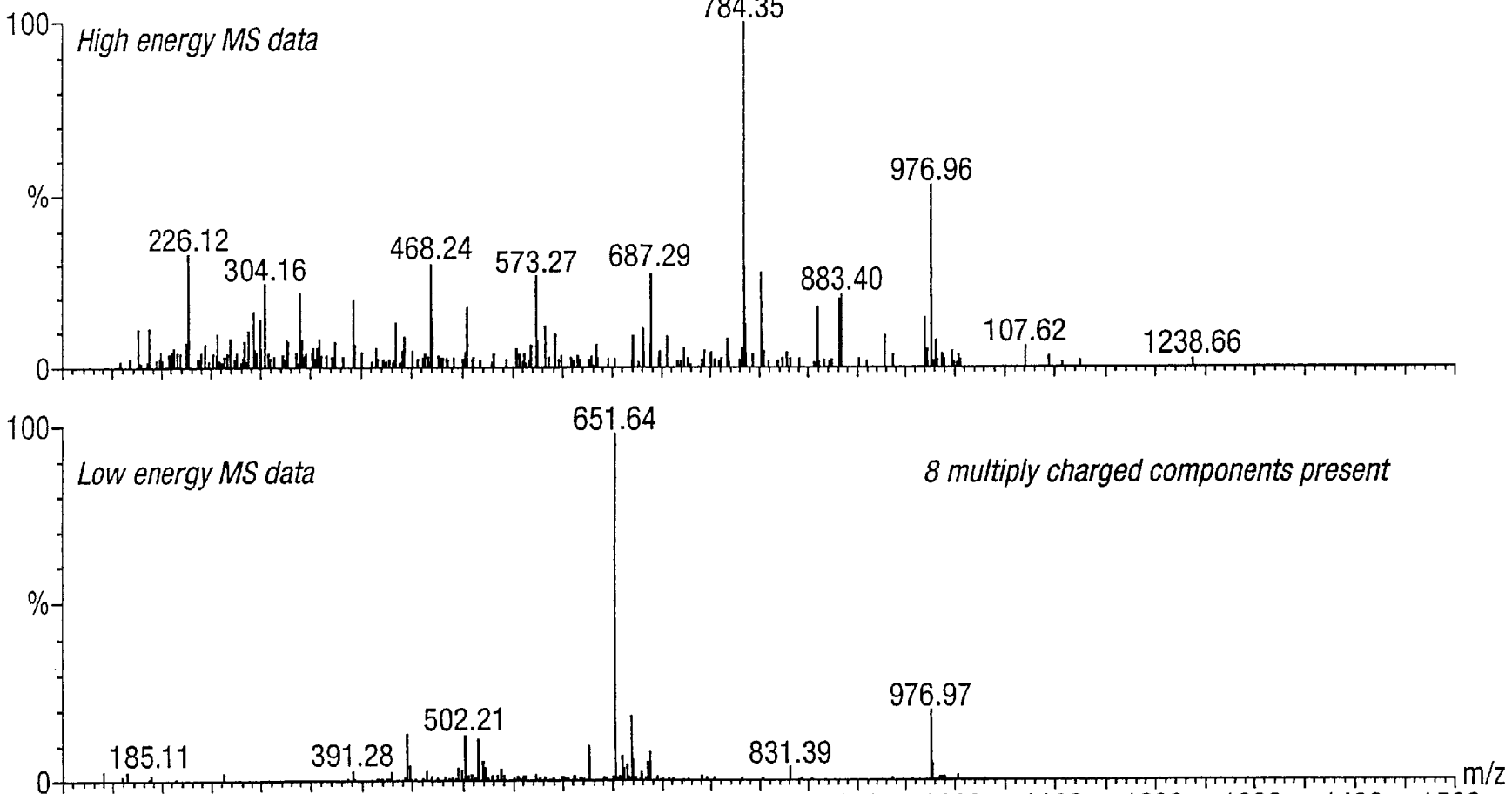
FIG. 7 shows low and high energy spectra at the time of elution of the 976.46 (2+) ion shown in FIG. 6.
Figure 8:
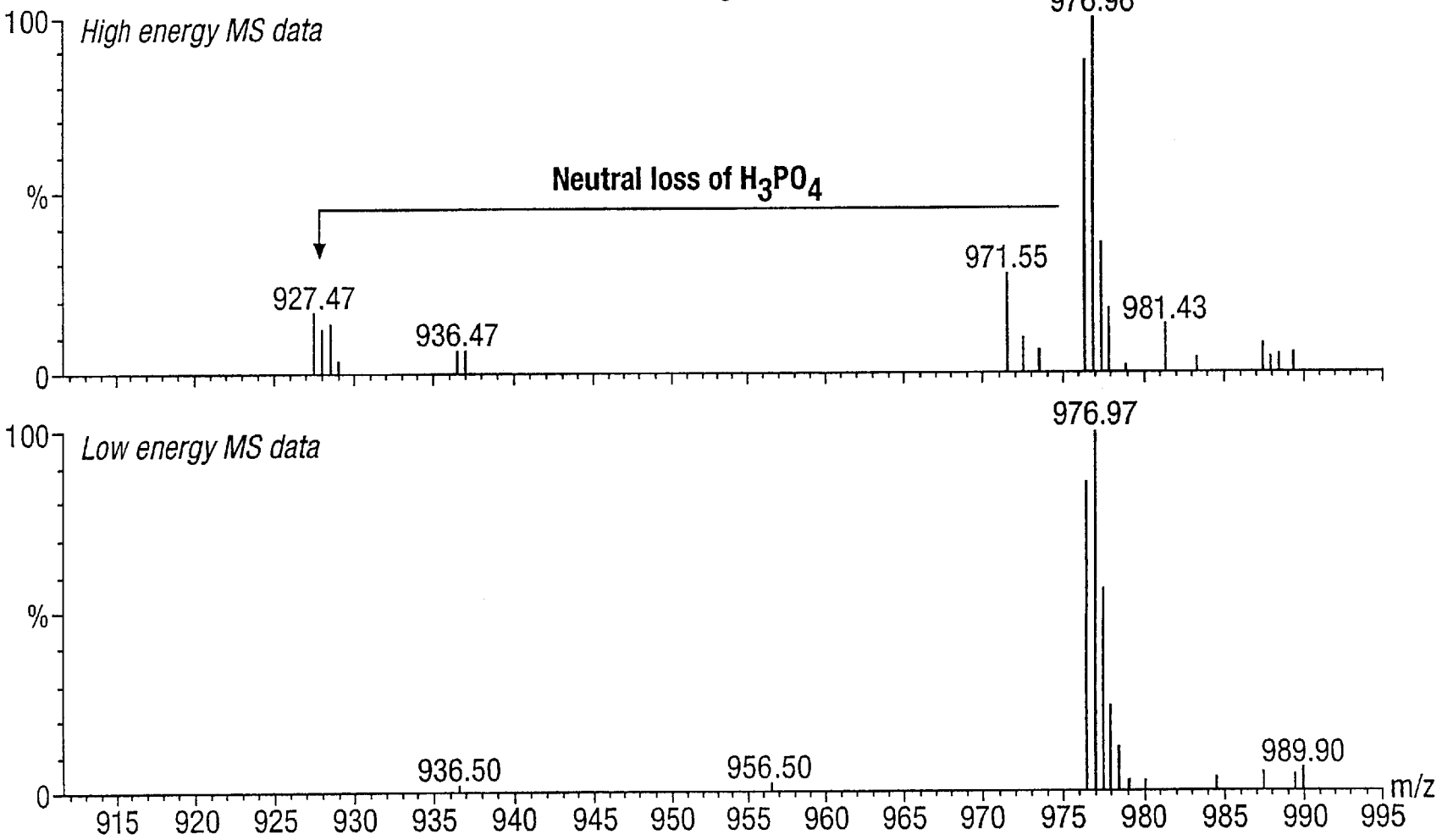
FIG. 8 shows an expanded view of low and high-energy spectra for m/z 910–995.

FIG. 7 shows the low and high-energy spectra at the time of elution for the 976.46 (2+) ion. The low energy spectrum contains a minimum of eight multiply charged ions. The high energy spectrum shows the complicated mixture of fragment ions derived from the eight peptides. An expanded view of m/z 910–995 is shown in FIG. 8 and reveals that the peptide at 976.46 (2+) has fragmented to produce an ion which is assigned as a neutral loss within the accurate mass window of ±20 mDa. All other product ions in the spectrum have not met the criteria to be assigned as a neutral loss.

Figure 9:
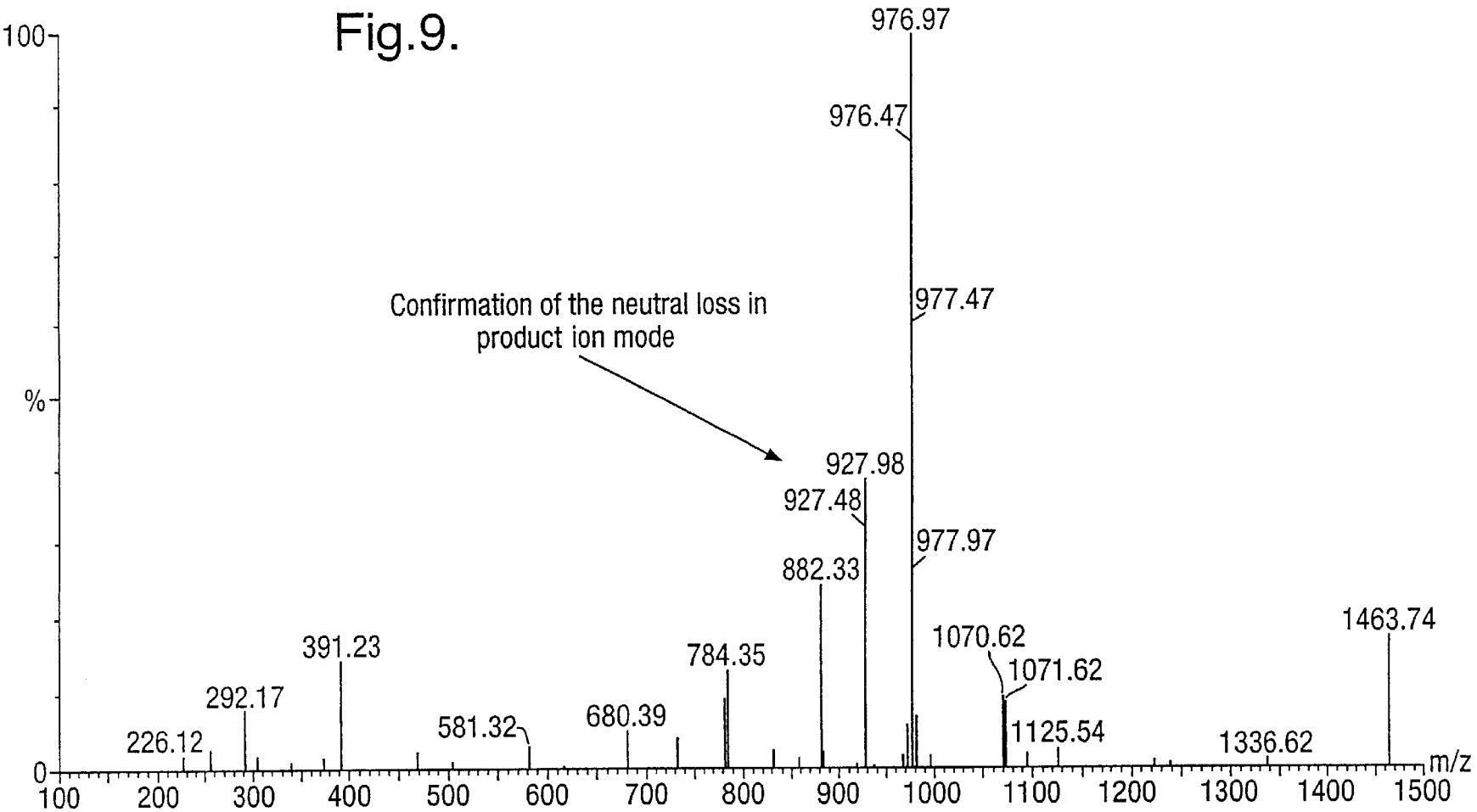
FIG. 9 shows confirmation of the neutral loss from 976.46 (2+) in product ion mode.
Figure 10:
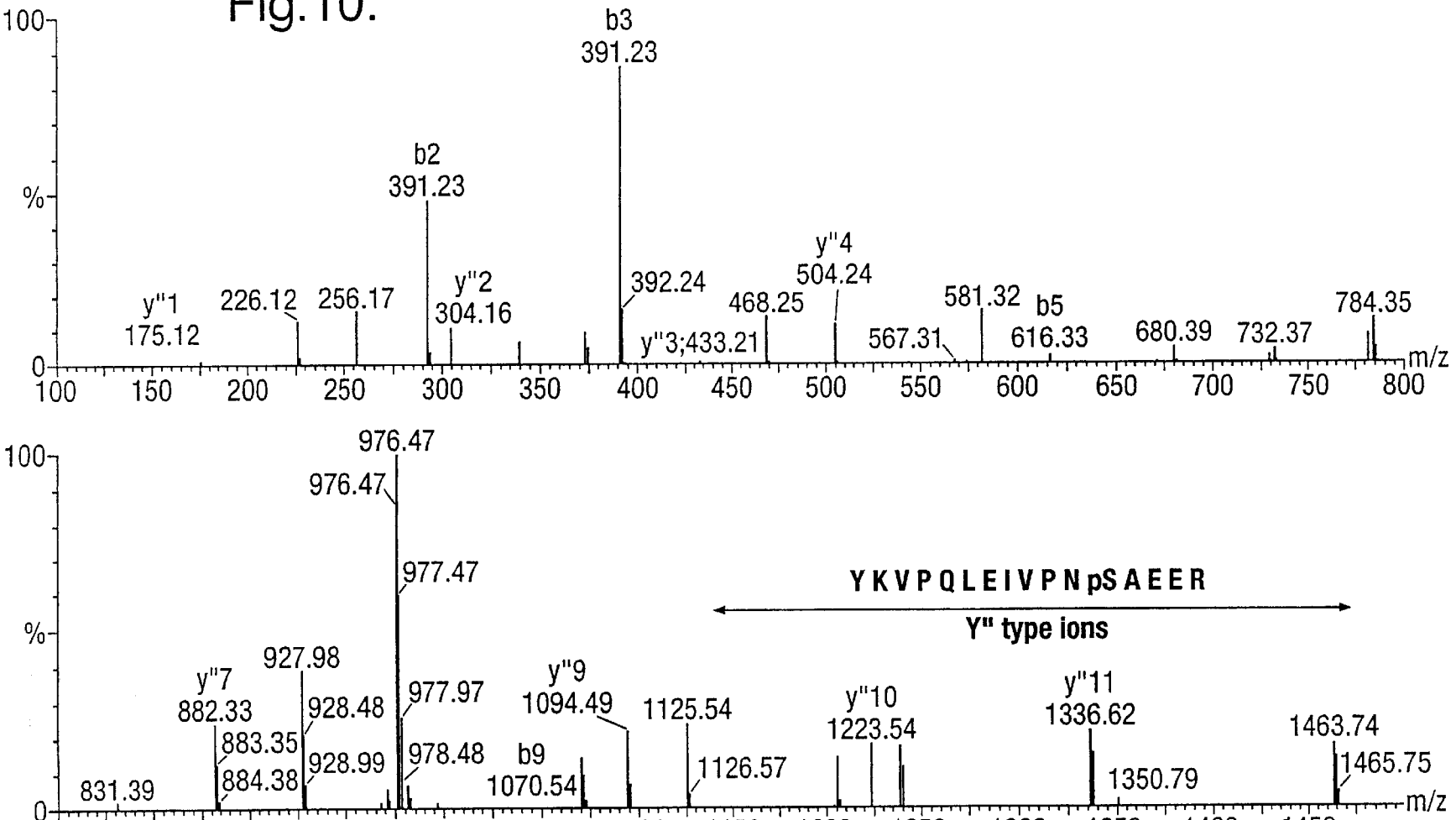
FIG. 10 shows an annotated product ion spectrum of 976.46 (2+)

Having registered the 976.46 (2+) ion as having undergone a neutral loss, the instrument then switches into a MS/MS mode. This confirms that the ion assigned as the neutral loss has arisen from the 976.46 (2+) ion and is not a coincidental fragment ion produced from one of the other peptides present in the source (see FIG. 9). The product ion spectrum also provides sequence information from the phosphorylated peptide (see FIG. 10).

Figure 11:
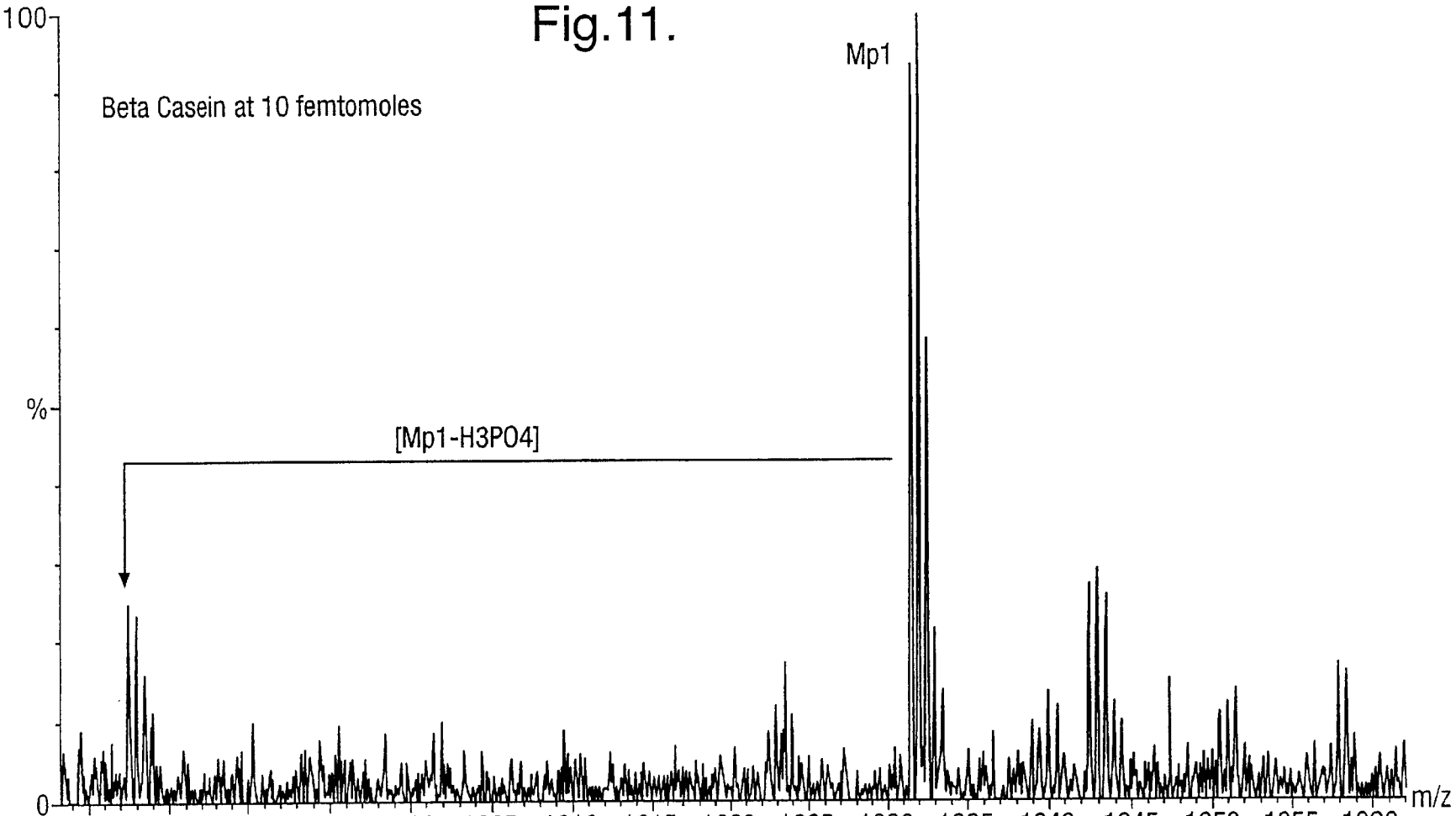
FIG. 11 shows neutral loss of $H_3PO_4$ from a digest peptide of beta casein at 10 fm injected on column.

FIG. 11 shows the neutral loss of $H_3PO_4$ from a beta casein digest peptide detected at a concentration of 10 fm injected on column.

In the case of phosphotyrosine, fragmentation to produce a neutral loss of $H_3PO_4$ does not occur. It does, however, decompose to produce a phosphorylated immonium ion at m/z 216 in positive ESI. The software can be directed to monitor for this ion, switching to a MS/MS mode when it appears in the high-energy spectrum.

EXAMPLE 2

Automated Discovery of a Peptide Containing the Amino Acid Asparagine

Figure 12:
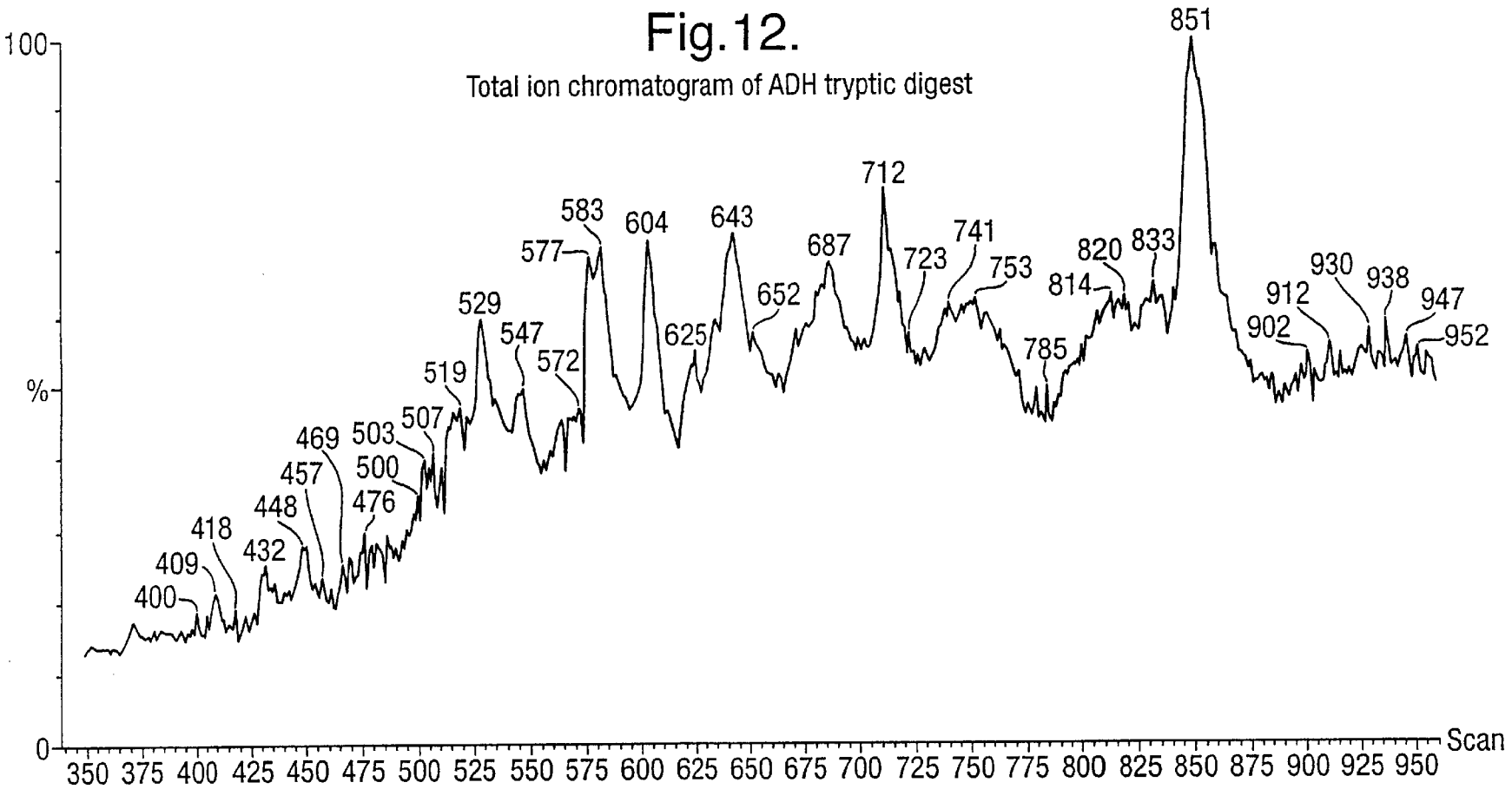
FIG. 12 shows a total ion chromatogram of a ADH tryptic digest.

The total ion chromatogram for the HPLC separation and mass analysis of the tryptic digest of the protein ADH (Alcohol Dehydrogenase) is shown in FIG. 12. This chromatogram was extracted from all the low energy spectra recorded on the Q-TOF tandem MS/MS system. For this data, the Q-TOF was operating in the MS mode and alternating between low and high collision energy in the gas collision cell for successive spectra.

Figure 13:
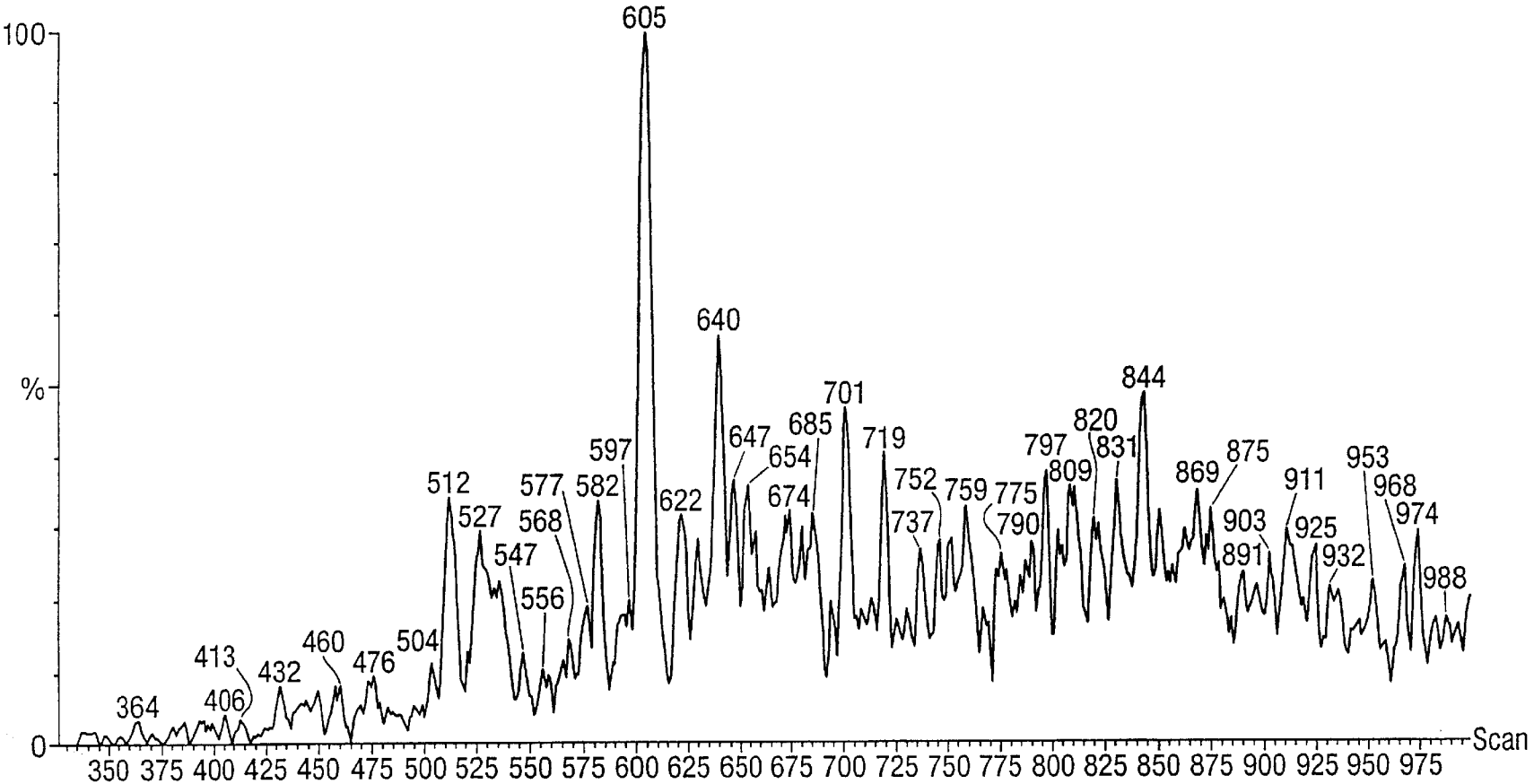
FIG. 13 shows a mass chromatogram of 87.04 (Asparagine immonium ion)

FIG. 13 show the mass chromatogram for m/z 87.04 extracted from the same HPLC separation and mass analysis as described in relation to FIG. 12 above. The immonium ion for the amino acid Asparagine has a m/z value of 87.04. This chromatogram was extracted from all the high energy spectra recorded on the Q-TOF.

Figure 14:
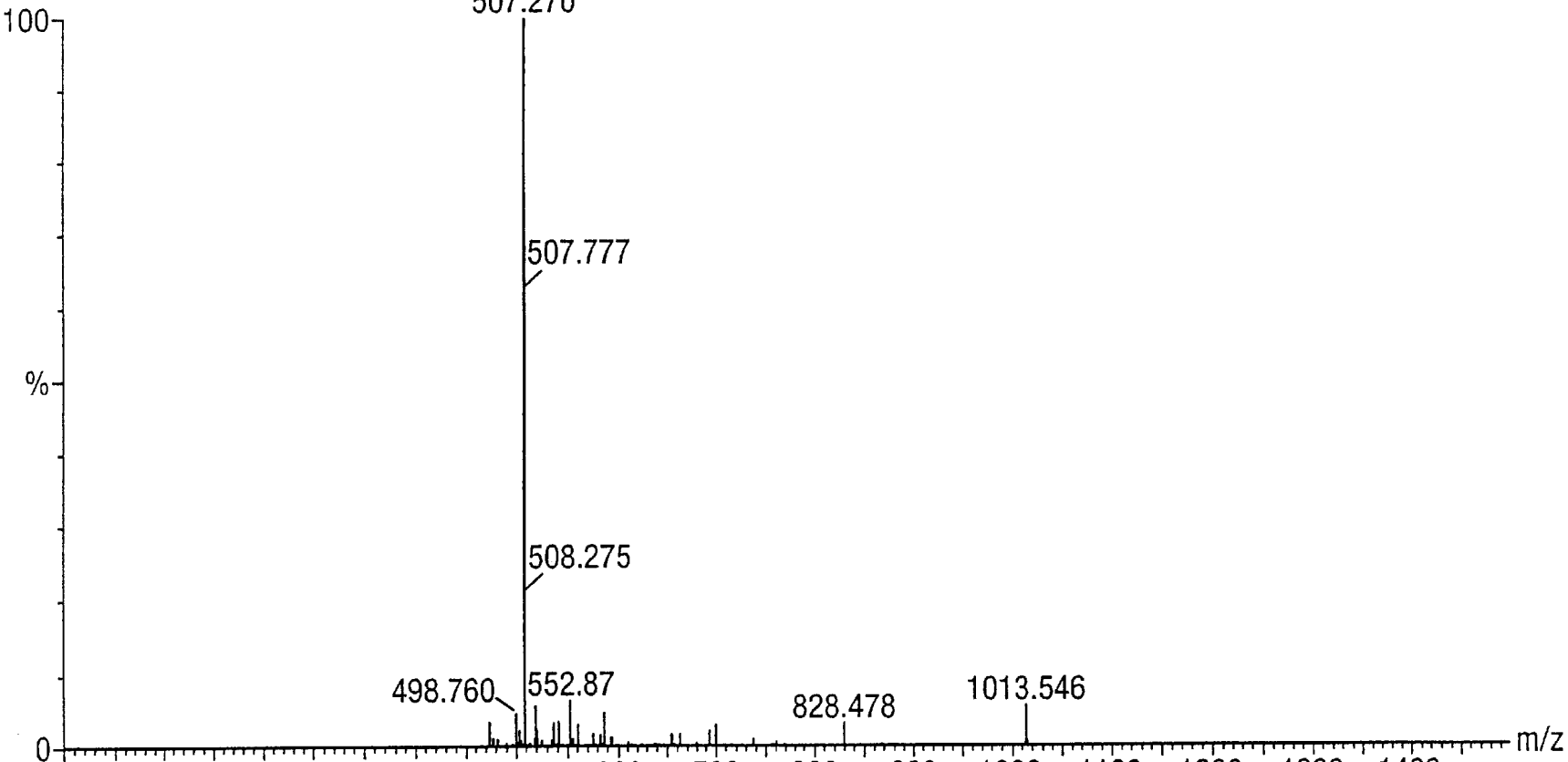
FIG. 14 shows a fragment T5 from ADH sequence ANELLINVK MW 1012.59.

FIG. 14 shows the full mass spectrum corresponding to scan number 604. This was a low energy mass spectrum recorded on the Q-TOF, and is the low energy spectrum next to the high energy spectrum at scan 605 that corresponds to the largest peak in the mass chromatogram of m/z 84.04. This shows that the parent ion for the Asparagine immonium ion at m/z 87.04 has a mass of 1012.54 since it shows the singly charged $(M+H)^+$ ion at m/z 1013.54, and the doubly charged $(M+2H)^{++}$ ion at m/z 507.27.

EXAMPLE 3

Automated Discovery of Phosphorylation of a Protein by Neutral Loss

Figure 15:
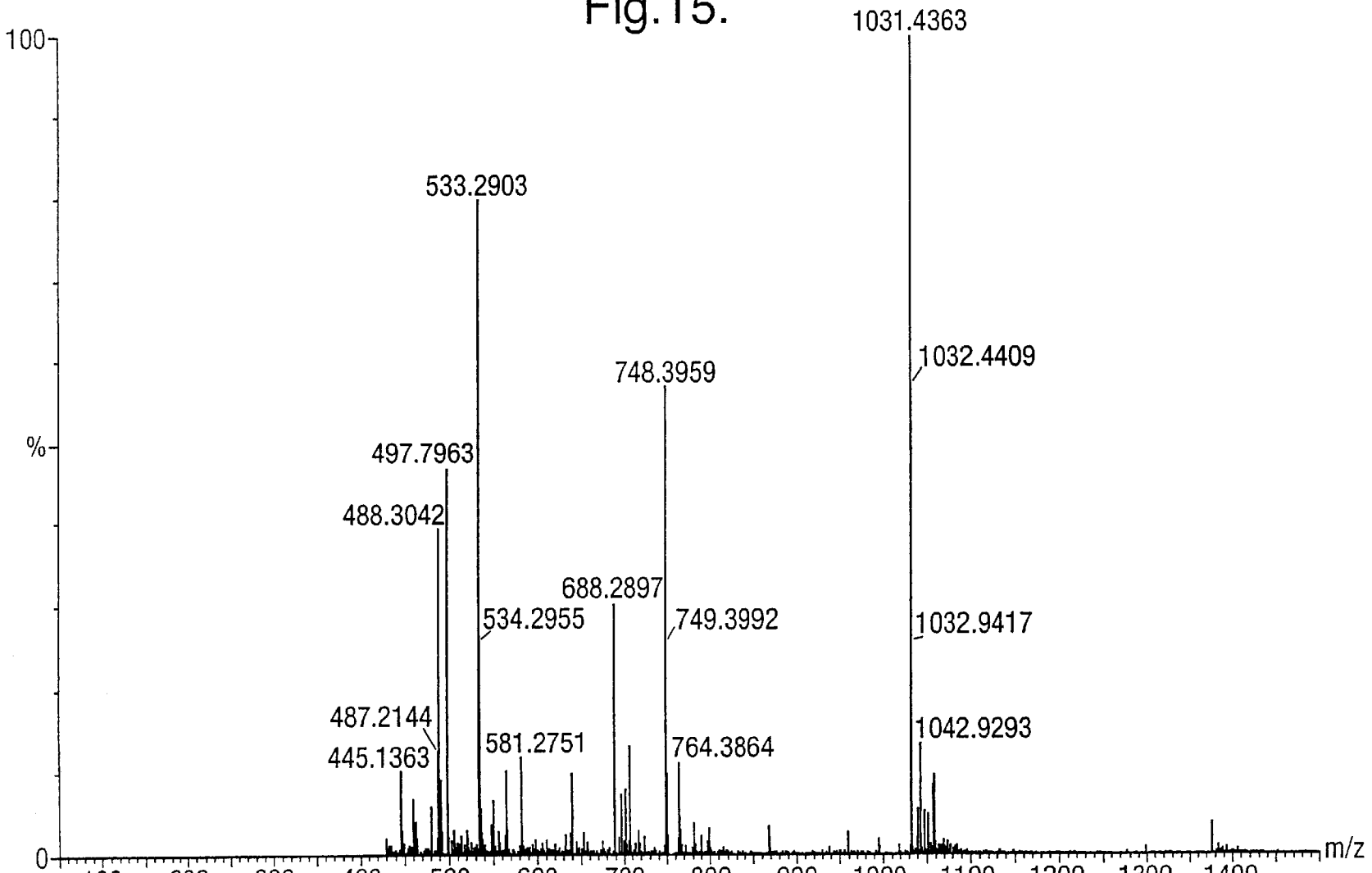
FIG. 15 shows a mass spectrum for the low energy spectra of a tryptic digest of β-Caesin.

FIG. 15 shows a mass spectrum from the low energy spectra recorded on a Q-TOF tandem MS/MS system of a tryptic digest of the protein β-Caesin. The protein digest products were separated by HPLC and mass analysed. The mass spectra were recorded on the Q-TOF operating in the MS mode and alternating between low and high collision energy in the gas collision cell for successive spectra.

Figure 16:
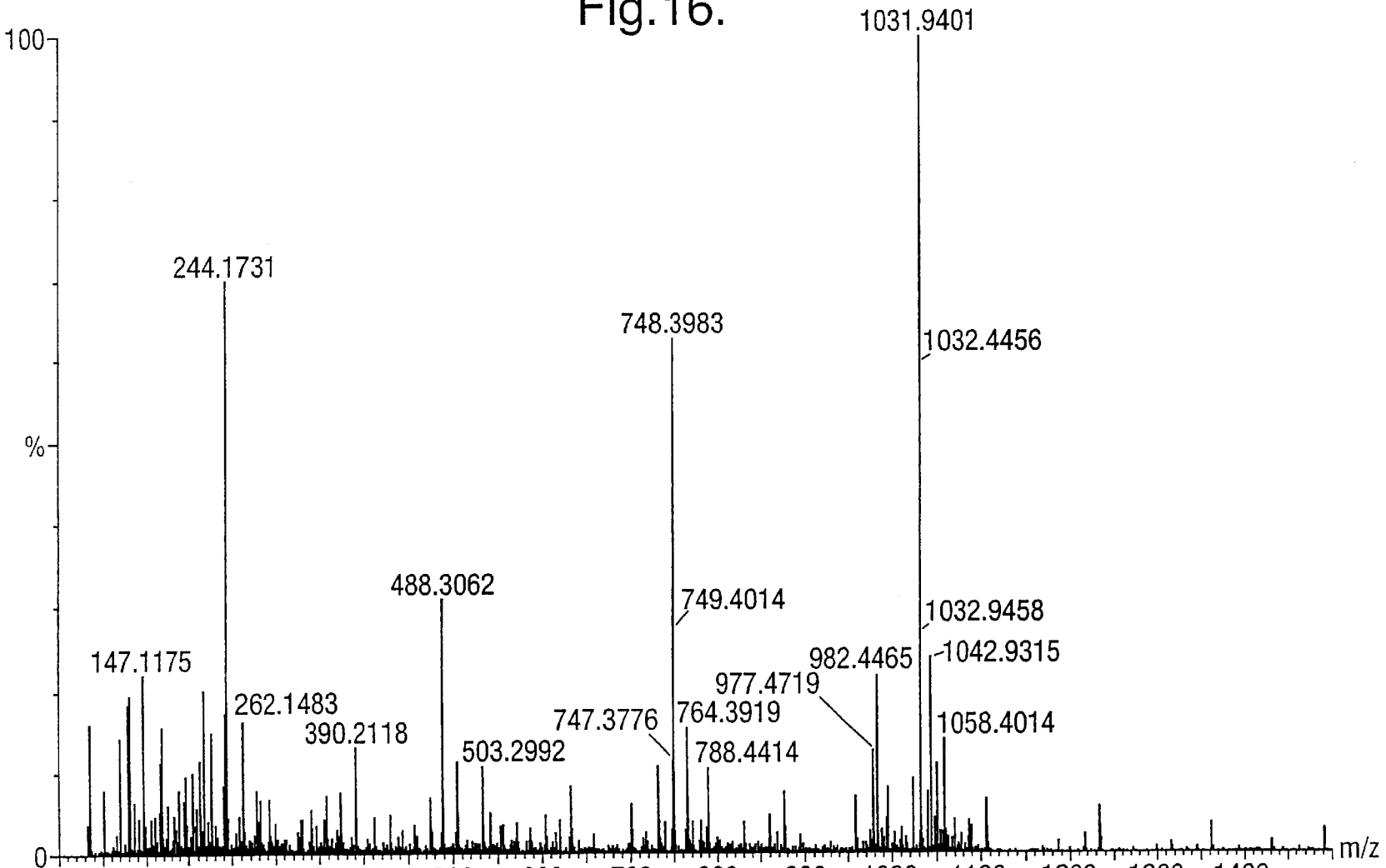
FIG. 16 shows a mass spectrum for the high energy spectra of a tryptic digest of β-Caesin.

FIG. 16 shows the mass spectrum from the high energy spectra recorded during the same period of the HPLC separation as that in FIG. 15 above.

Figure 17:
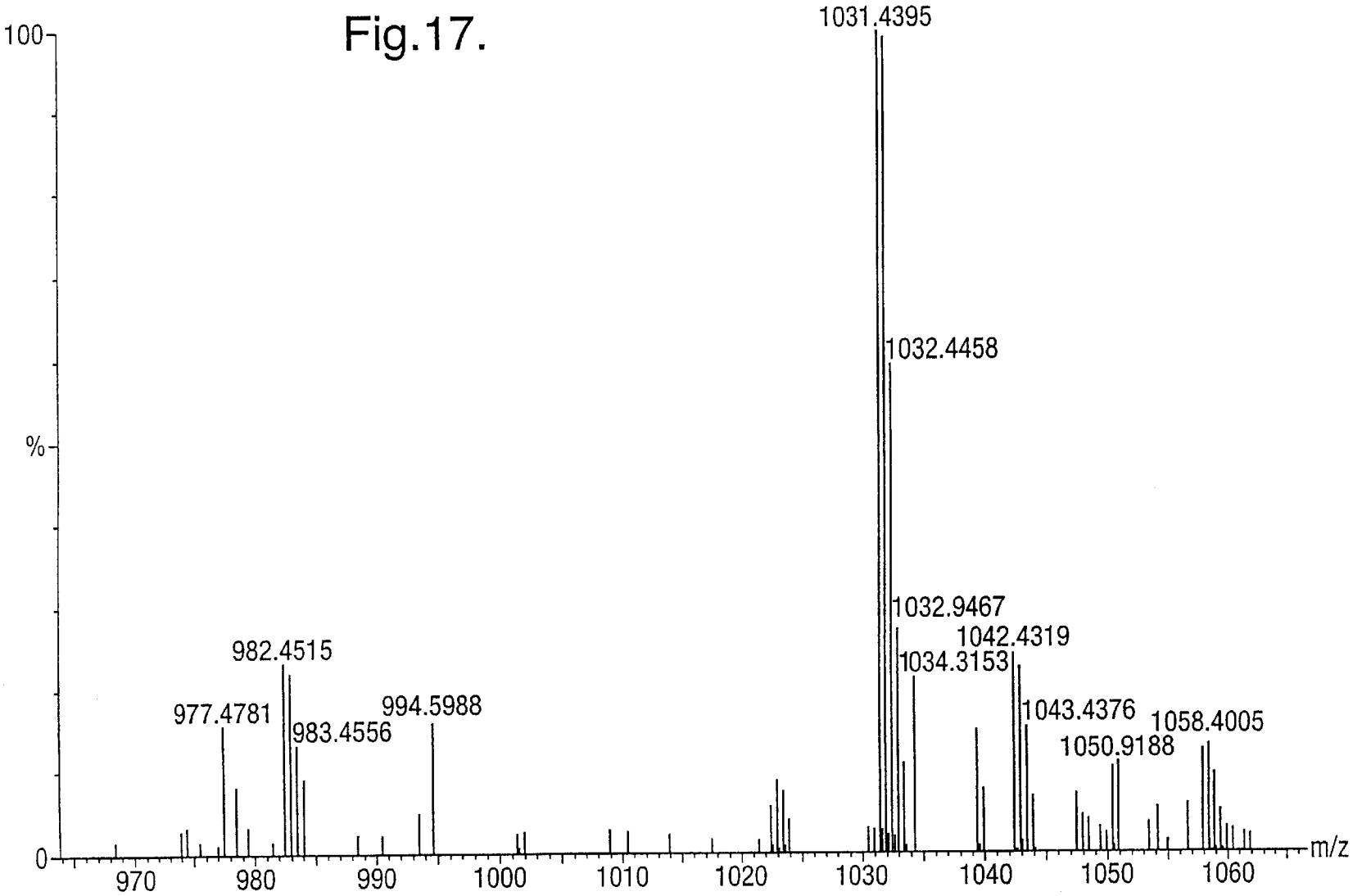
FIG. 17 shows a processed and expanded view of the same spectrum as in FIG. 16.

FIG. 17 shows a processed and expanded view of the same spectrum as in FIG. 16 above. For this spectrum, the continuum data has been processed such to identify peaks and display as lines with heights proportional to the peak area, and annotated with masses corresponding to their centroided masses. The peak at m/z 1031.4395 is the doubly charged $(M+2H)^{++}$ ion of a peptide, and the peak at m/z 982.4515 is a doubly charged fragment ion. It has to be a fragment ion since it is not present in the low energy spectrum. The mass difference between these ions is 48.9880. The theoretical mass for $H_3PO_4^{++}$ is 97.9769, and the m/z value for the doubly charged $H_3PO_4^{++}$ ion is 48.9884, a difference of only 8 ppm from that observed.

EXAMPLE 4

Discovery of a Parent Ion of a Phosphorylated Peptide by Recognition of a Characteristic Neutral Loss A Q-TOF2 mass spectrometer was set up to acquire mass spectra, with collision gas in the collision cell, and with the acquisition set to acquire alternate high and low energy spectra. When a daughter ion, with a mass difference from a candidate parent ion corresponding to the loss of the $H_3PO_4$ ion, was identified the system would automatically switch to acquire the MS/MS spectrum of that candidate parent ion.

The following is an example of such an acquisition. The protein α-casein was digested, and 100 fmol of the digest was injected for separation by liquid chromatography before spraying into the electrospray source of the Q-TOF2.

Figure 18:
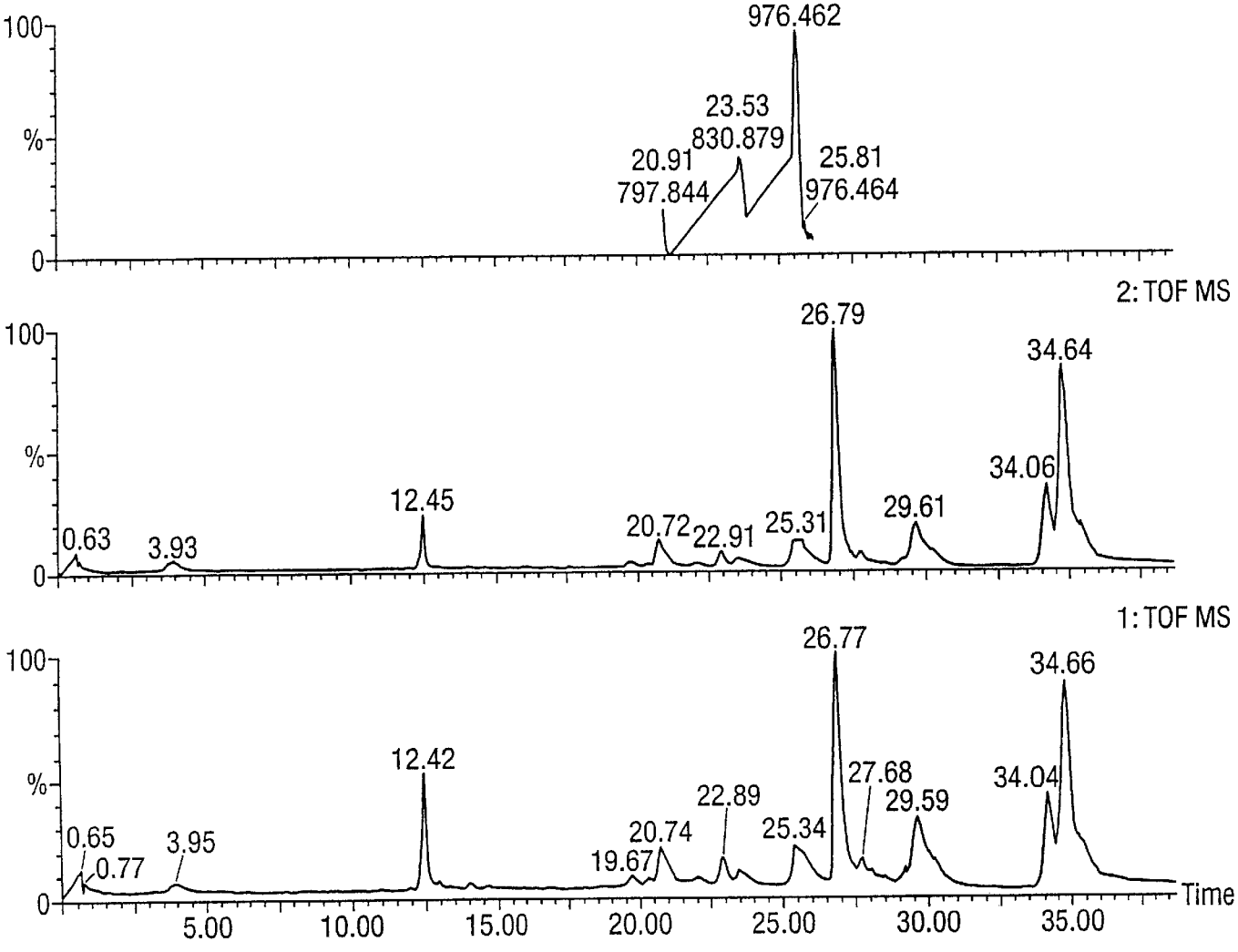
FIG. 18 shows chromatograms for α-casein.

FIG. 18 shows from bottom to top the following chromatograms: (1) the TIC (total ion current) chromatogram for the low energy MS mode; (2) the TIC chromatogram for the high energy MS mode; and (3) the TIC chromatogram for the MS/MS mode.

The chromatogram peaks eluting at 20.9, 23.5 and 25.5 minutes are chopped in the chromatograms displayed in traces (1) and (2). This is because for these three peaks the system switched into the MS/MS mode part way through the elution of the peaks. This is indicated in trace (3), which shows the times at which MS/MS spectra were acquired.

Figure 19:
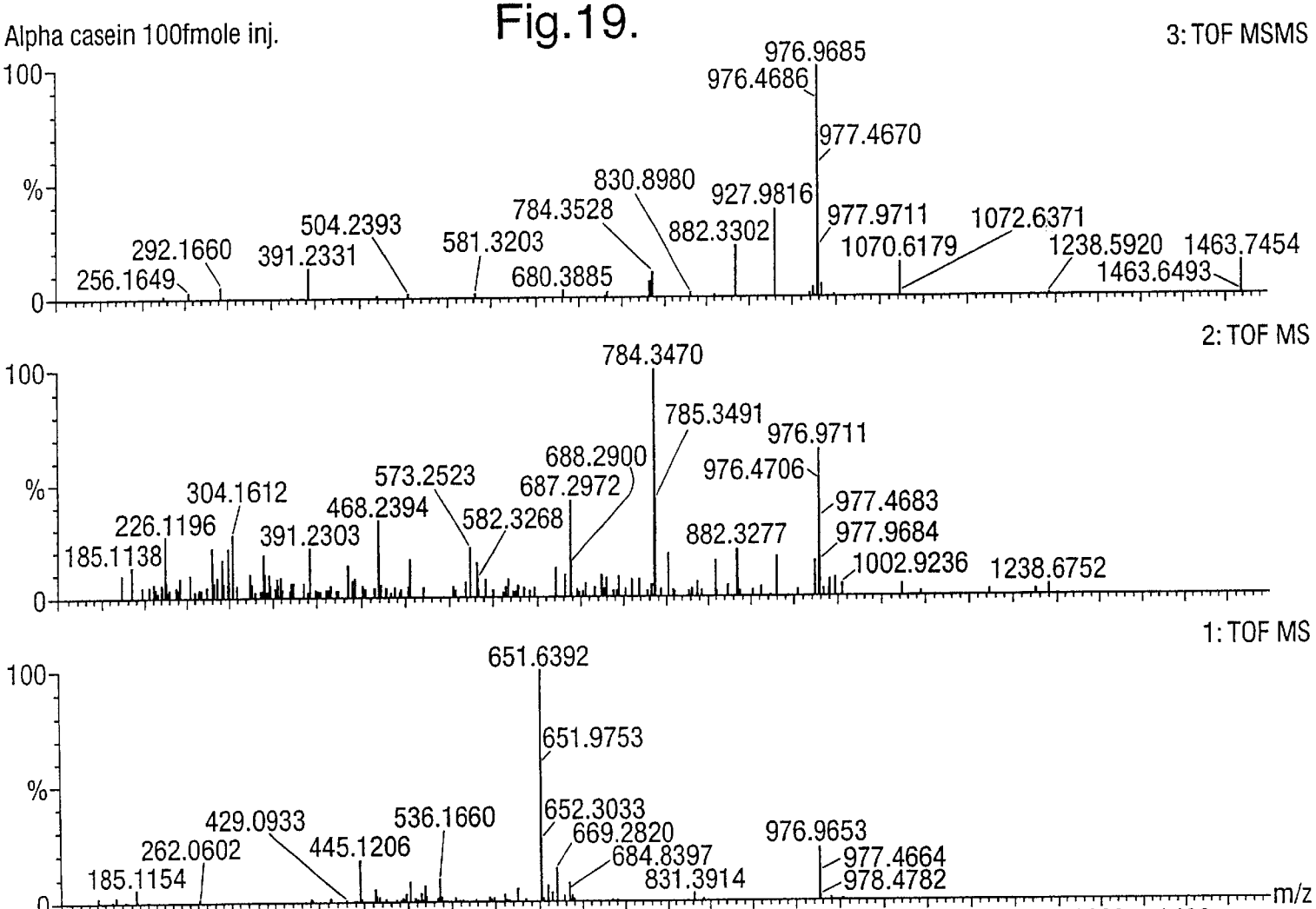
FIG. 19 shows mass spectra for α-casein.

FIG. 19 shows from bottom to top the following mass spectra: (1) the low energy mass spectrum at 25.335 minutes into the run; (2) the high energy mass spectrum at 25.315 minutes into the run; and (3) the full MS/MS spectrum for m/z range 976–978 at 25.478 minutes into the run.

The spectrum in trace (1) shows the low energy mass spectrum at time 25.335 minutes. It mainly shows the doubly charged ion (m/z 976.4) and the triply charged ion (m/z 651.6) for a peptide with a mass of 1952 Daltons. The spectrum in trace (2) shows the high-energy spectrum at time 25.315 minutes, and shows a new peak at m/z 927 (not labelled). This has to be a daughter ion, since it is not present in the low energy spectrum, and it has a difference in m/z of 49 from the parent ion at m/z 976. This mass corresponds to that of the doubly charged $H_3PO_4^{++}$ ion. The system has automatically recognised this mass difference and switched to record the MS/MS spectrum from the m/z range 976–978. The MS/MS spectrum confirms that the peak at m/z 927, corresponding to the loss of the doubly charged $H_3PO_4^{++}$ ion, is from that parent ion at m/z 976. It also shows other fragment ions from that parent ion, thereby allowing confirmation of the identity of the peptide.

What is claimed is:

1. A method of mass spectrometry comprising the steps of:

providing an ion source which generates ions;

filtering said ions so that ions having a mass-to-charge ratio within a first range are substantially transmitted and so that the transmission of ions having a mass-to-charge ratio outside of said first rang is substantially reduced;

passing the filtered ions to a fragmentation means operated in a first mode wherein at least a portion of the filtered ions are fragmented to produce daughter ions;

mass analysing of at least some of the ions which have passed through said fragmentation means operating in said first mode;

characterised in that said method further comprises the steps of:

identifying as daughter ions, at least some ions which are determined to have a mass-to-charge ratio which falls outside of said first range;

wherein if one or more daughter ions are determined to be present, then said method further comprises the step of determining whether said one or more daughter ions correspond with one or more predetermined daughter ions, and wherein if it is determined that said one or more daughter ions does correspond with one or more predetermined daughter ions, then said method further comprises the steps of:

operating said fragmentation means in a second mode wherein substantially less of the filtered ions are fragmented than in said first mode; and then mass analysing at least spine of the ions which have passed through said fragmentation means operating in said second mode.

2. A method of mass spectrometry as claimed in claim 1, wherein said first range is variable.

3. A method of mass spectrometry as claimed in claim 1, wherein the step of mass analysing at least some of the ions which have passed through said fragmentation means operating in said first mode comprises obtaining a first mass spectrum and wherein the step of mass analysing at least some of the ions which have passed through said fragmentation means operating in said second mode comprises obtaining a second mass spectrum.

4. A method of mass spectrometry as claimed in claim 3, wherein after the step of mass analysing at least some of the ions which have been passed through said fragmentation means operating in said second mode, said method further comprises the step of identifying at least one candidate parent ion.

5. A method of mass spectrometry as claimed in claim 4, wherein said at least one candidate parent ion is identified by comparing the intensity of ions having a certain mass-to-charge ratio in said first mass spectrum with the intensity of ions having the same mass-to-charge ratio in said second mass spectrum.

6. A method of mass spectrometry as claimed in claim 4, further comprising the steps of:

filtering the ions upstream of said fragmentation means so that ions having a mass-to-charge ratio within a second range which includes at least one candidate parent ion are arranged to be substantially transmitted to said fragmentation means and so that the transmission of ions having a mass-to-charge ratio outside of said second range is substantially reduced;

operating said fragmentation means so that substantially more of said ions are fragmented than in said second mode; and then mass analysing at least some of the ions which have passed through said fragmentation means.

7. A method of mass spectrometry as claimed in claim 6, wherein said second range is selected so hat only ions having mass-to-charge ratios within ±x mass-to-charge units of a candidate parent ion are substantially transmitted to said fragmentation means, wherein x is selected from the group consisting of: (i) 0.5; (ii) 1.0; (iii) 2.0; (iv) 5.0; (v) 10.0; (vi) 15.0; and (vii) 20.0.

8. A method of mass spectrometry as claimed in claim 1, wherein said ion source is selected from the group consisting of: (i) an electrospray ion source; (ii) an atmospheric pressure chemical ionization ion source; and (iii) a matrix assisted laser desorption ion source.

9. A method of mass spectrometry as claimed in claim 8, wherein said ion source is provided with an eluent over a period of time, said eluent having been separated from a mixture by means of liquid chromatography.

10. A method of mass spectrometry as claimed in claim 1, wherein said ion source is selected from the group consisting of: (i) an electron impact ion source; (ii) a chemical ionization ion source; and (iii) a field ionisation ion source.

11. A method of mass spectrometry as claimed in claim 10, wherein said ion source is provided with an eluent over a period of time, said eluent having been separated from a mixture by means of gas chromatography.

12. A method of mass spectrometry as claimed in claim 1, wherein said mass analysing steps are performed by an analyser selected from the group comprising: (i) a quadrupole mass filter; (ii) a time-of-flight mass analyser; (iii) an ion trap; (iv) a magnetic sector analyser; and (v) a Fourier Transform Ion Cyclotron Resonance ("FTICR") mass analyser.

13. A method of mass spectrometry as claimed in claim 1, wherein said filtering step(s) are performed by a multi-element ion optical lens.

14. A method of mass spectrometry as claimed in claim 13, further comprising providing both a RF and a DC electric field to said multi-element ion optical lens.

15. A method of mass spectrometry as claimed in claim 13, wherein said multi-element ion optical lens is arranged to substantially transmit only ions having mass-to-charge ratios greater than a first value.

16. A method of mass spectrometry as claimed in claim 15, wherein said first value is selected from the group comprising: (i) 100; (ii) 150; (iii) 200; (iv) 250; (v) 300; (vi) 350; (vii) 400; (viii) 450; and (ix) 500.

17. A method of mass spectrometry as claimed in claim 15, wherein the step of identifying daughter ions comprises identifying at least some ions which are determined to have mass-to-charge ratios less than said first value.

18. A method of mass spectrometry as claimed in claim 1, wherein said fragmentation means comprises a collision cell selected from the group consisting of: (i) a quadrupole rod set; (ii) an hexapole rod set; (iii) an octopole rod set; and (iv) an electrode ring set.

19. A method of mass spectrometry as claimed in claim 18, wherein said collision cell is operated in a RF only mode.

20. A method of mass spectrometry as claimed in claim 18, further comprising the step of providing a collision gas to said collision cell at a pressure within the range $10^{-4}$ to $10^{-1}$ mbar.

21. A method of mass spectrometry as claimed in claim 20, wherein the collision gas is provided to said collision cell at a pressure within the range $10^{-3}$ to $10^{-2}$ mbar.

22. A method of mass spectrometry as claimed in claim 18, wherein said collision cell forms a substantially gas-tight enclosure.

23. A method of mass spectrometry as claimed in claim 1, wherein said predetermined daughter ions comprises ions selected from the group comprising: (i) immonium ions from peptides; (ii) functional groups including phosphate group $PO_3^-$ ions from phosphorylated peptides; and (iii) mass tags which are intended to cleave from a specific molecule or class of molecule and to be subsequently identified thus reporting the presence of said specific molecule or class of molecule.

24. A method of mass spectrometry as claimed in claim 1, wherein operating said fragmentation means in said first mode comprises the step of supplying a voltage to said fragmentation means selected from the group consisting of: (i) ≧15V; (ii) ≧20V; (iii) ≧25V; (iv) ≧30V; (v) ≧50V; (vi) ≧100V; (vii) ≧150V; and (viii) ≧200V.

25. A method of mass spectrometry as claimed in claim 1, wherein operating said fragmentation means in said second mode comprises the step of supplying a voltage to said fragmentation means selected from the group consisting of: (i) ≦5V; (ii) ≦4.5V; (iii) ≦4V; (iv) ≦3.5V; (v) ≦3V; (vi) ≦2.5V; (vii) ≦2V; (viii) ≦1.5V; (ix) ≦1V; (x) ≦0.5V; and (xi) substantially OV.

26. A method of mass spectrometry comprising the steps of:

providing an ion source which generates ions;

filtering said ions so that substantially only ions having a mass-to-charge ratio greater than a first value are transmitted, said first value being between 100 and 500;

passing the filtered ions to a fragmentation means operated in a first mode with an applied voltage ≧15V wherein at least a portion of the filtered ions are fragmented to produce daughter ions;

mass analysing at least some of the ions which have passed through said fragmentation means operating in said first mode;

characterised in that said method further comprises the steps of:

identifying as daughter ions, at least some ions which are determined to have mass-to-charge ratios less than said first value;

wherein if one or more daughter ions are determined to be present, then said method further comprises the step of determining whether said one or more daughter ions correspond with one or more predetermined daughter ions, and wherein if it is determined that said one or more daughter ions does correspond with one or more predetermined daughter ions, then said method further comprises the steps of:

operating said fragmentation means in a second mode with an applied voltage ≦5V wherein substantially less of aid ions are fragmented than in said first mode; and then mass analysing at least some of the ions which have passed through said fragmentation means operating in said second mode.

27. A mass spectrometer comprising:

an ion source for generating ions;

a multi-element ion optical lens for filtering ions so that ions having a mass-to-charge ratio within a first range are substantially transmitted and so that the transmission of ions having a mass-to-charge ratio outside of said first range is substantially reduced;

a fragmentation means arranged and adapted to be operated in a first mode wherein at least a portion of the ions received by said fragmentation means are fragmented to produce daughter ions;

a mass analyser for mass analysing at least some of the ions which have passed through said fragmentation means operating in said first mode; and a control system for controlling said mass spectrometer;

characterised in that:

said control system is arranged to identify as daughter ions, at least some ions which are determined to have a mass-to-charge ratio which falls outside of said first range, wherein if one or more daughter ions are determined to be present, then said control system determines whether said one or more daughter ions correspond with one or more predetermined daughter ions, and wherein if said control system determines that said one or more daughter ions does correspond with one or more predetermined daughter ions, then said control system switches said fragmentation means so as to operate in a second mode wherein substantially less of the ions received by said fragmentation means are fragmented than in said first mode and whereupon said mass analyser is arranged to mass analyse at least some of the ions which have passed through said fragmentation means operating in said second mode.

28. A mass spectrometer as claimed in claim 27, wherein said mass analyser is selected from the group comprising: (i) a quadrupole mass filter; (ii) a time-of-flight mass analyser; (iii) an ion trap; (iv) a magnetic sector analyser; and (v) a Fourier Transform Ion Cyclotron Resonance ("FTICR") mass analyser.

29. A mass spectrometer as claimed in claim 27, wherein said multi-element ion optical lens comprises a quadrupole mass filter.

30. A mass spectrometer as claimed in claim 27, wherein said fragmentation means comprises collision cell selected from the group consisting of: (i) a quadrupole rod set; (ii) an hexapole rod set; (iii) an octopole rod set; and (iv) an electrode ring set.

31. A mass spectrometer as claimed in claim 30, wherein said collision cell forms a substantially gas-tight enclosure.

32. A mass spectrometer comprising:

an ion source for generating ions;

a multi-element ion optical lens for filtering ions so that ions having a mass-to-charge ratio greater than a first value are substantially transmitted and so that the transmission of ions having a mass-to-charge ratio less than said first value is substantially reduced, said first value being between 100 and 500;

a fragmentation means arranged and adapted to be operated in a first mode with an applied voltage ≧15V wherein at least a portion of the ions received by said fragmentation means are fragmented to produce daughter ions; and a mass analyser for mass analysing at least some of the ions which have passed through said fragmentation means operating in said first mode;

wherein:

said mass spectrometer is configured to identify as daughter ions, at least some ions which are determined to have a mass-to-charge ratio which is less than said first value, wherein if one or more daughter ions are determined to be present, then said mass spectrometer is arranged to determine whether said one or more daughter ions correspond with one or more predetermined daughter ions, and wherein if it is determined that said one or more daughter ions does correspond with one or more predetermined daughter ions, then said mass spectrometer is arranged and adapted to switch said fragmentation means so as to operate in a second mode with an applied voltage ≦5V wherein substantially less of the ions received by said fragmentation means are fragmented than in said first mode and whereupon aid mass analyser is arranged to mass analyse at least some of the ions which have passed through said fragmentation means operating in said second mode.

33. A method of mass spectrometry comprising the steps of:

providing an ion source which generates ions;

characterised in that said method further comprises the steps of:

passing the ions to a fragmentation means which operates in at least a first mode wherein at least a portion of the ions are fragmented to produce daughter ions and a second mode wherein substantially less of the ions are fragmented than in said first mode;

mass analysing at least some of the ions which have passed through said fragmentation means operating in said first mode;

mass analysing at least some of the ions which have passed through said fragmentation means operating in said second mode;

identifying at least one daughter ion and at least one candidate parent ion; and determining whether: (i) said at least one daughter ion corresponds with one or more predetermined daughter ions; and/or (ii) said at least one daughter ion and said at least one candidate parent ion could be related by the loss of a predetermined ion or neutral particle.

34. A method of mass spectrometry as claimed in claim 33, further comprising: filtering the ions upstream of said fragmentation means so that ions having a mass-to-charge ratio within a first range are substantially transmitted and so that the transmission of ions having a mass-to-charge ratio outside of said first range is substantially reduced.

35. A method of mass spectrometry as claimed in claim 34, wherein said first range is variable.

36. A method of mass spectrometry as claimed in claim 34, wherein the step of identifying at least one daughter ion comprises determining at least some ions which have a mass-to-charge ratio which falls outside of said first range.

37. A method of mass spectrometry as claimed in claim 33, wherein the step of mass analysing at least some of the ions which have passed through said fragmentation means operating in said first mode comprises obtaining a first mass spectrum and wherein the step of mass analysing at least some of the ions which have passed through said fragmentation means operating in said second mode comprises obtaining a second mass spectrum.

38. A method of mass spectrometry as claimed in claim 37, wherein said at least one candidate parent ion is identified by comparing the intensity of ions having a certain mass-to-charge ratio in said first mass spectrum with the intensity of ions having the same mass-to-charge ratio in said second mass spectrum.

39. A method of mass spectrometry as claimed in claim 37, wherein said at least one daughter ion is identified by comparing the intensity of ions having a certain mass-to-charge ratio in said first mass spectrum with the intensity of ions having the same mass-to-charge ratio in said second mass spectrum.

40. A method of mass spectrometry as claimed in claim 33, wherein if it is determined that: (i) said at least one daughter ion corresponds with a predetermined daughter ion; an or (ii) said at least one daughter ion and said at least one candidate parent ion could be related by the loss of a predetermined ion or neutral particle, then said method further comprises the steps of:

filtering the ions upstream of said fragmentation means so that ions having a mass-to-charge ratio within a second range which includes at least one candidate parent ion are arranged to be substantially transmitted to said fragmentation means and so that the transmission of ions having mass-to-charge ratio outside of said second range is substantially reduced;

operating said fragmentation means so that substantially more of said ions are fragmented than in said second mode; and mass analysing at least same of the ions which have passed through said fragmentation means.

41. A method of mass spectrometry as claimed in claim 40, wherein said second range is selected so that only ions having mass-to-charge ratios within ±x mass-to-charge units of a candidate parent ion are substantially transmitted to said fragmentation means, wherein x is selected from the group consisting of: (i) 0.5; (ii) 1.0; (iii) 2.0; (iv) 5.0; (v) 10.0; (i) 15.0; and (vii) 20.0.

42. A method of mass spectrometry as claimed in claim 33, wherein said ion source is selected from the group consisting of: (i) an electro spray ion source; (ii) an atmospheric pressure chemical ionization ion source; and (iii) a matrix assisted laser desorption ion source.

43. A method of mass spectrometry as claimed in claim 42, wherein said ion source is provided with an eluent over a period of time, said eluent having been separated from a mixture by means of liquid chromatography.

44. A method of mass spectrometry as claimed in claim 33, wherein said ion source is selected from the group consisting of: (i) an electron impact ion source; (ii) a chemical ionization ion source; and (iii) a field ionisation ion source.

45. A method of mass spectrometry as claimed in claim 44, wherein said ion source is provided with an eluent over a period of time, said eluent having been separated from a mixture by means of gas chromatography.

46. A method of mass spectrometry as claimed in claim 33, wherein said mass analysing steps are performed by an analyser selected from the group comprising: (i) a quadrupole mass filter; (ii) a time-of-flight mass analyser; (iii) an ion trap; (iv) a magnetic sector analyser; and (v) a Fourier Transform Ion Cyclotron Resonance ("FTICR") mass analyser.

47. A method of mass spectrometry as claimed in claim 34, wherein said filtering step(s) are performed by a multi-element ion optical lens.

48. A method of mass spectrometry as claimed in claim 47, further comprising providing both a RF and a DC electric field to said multi-element ion optical lens.

49. A method of mass spectrometry as claimed in claim 47, wherein said multi-element ion optical lens is arranged to substantially transmit only ions having mass-to-charge ratios greater than a first value.

50. A method of mass spectrometry as claimed in claim 49, wherein said first value is selected from the group comprising: (i) 100; (ii) 150; (iii) 200; (iv) 250; (v) 300; (vi) 350; (vii) 400; (viii) 450; and (ix) 500.

51. A method of mass spectrometry as claimed in claim 49, wherein the step of identifying daughter ions comprises identifying at least some ions which are determined to have mass-to-charge ratios less than said first value.

52. A rod of mass spectrometry as claimed in claim 33, wherein said fragmentation means comprises a collision cell selected from the group consisting of: (i) a quadrupole rod set; (ii) an hexapole rod set; (iii) an octopole rod set; and (iv) an electrode ring set.

53. A method of mass spectrometry as claimed in claim 52, wherein said collision cell is operated in a RF only mode.

54. A method of mass spectrometry as claimed in claim 52, further comprising the step of providing a collision gas to said collision cell at a pressure within the range $10^{-3}$ to $10^{-1}$ mbar.

55. A method of mass spectrometry as claimed in claim 54, wherein the collision gas is provided to said collision cell at a pressure within the range $10^{-3}$ to $10^{-2}$ mbar.

56. A method of mass spectrometry as claimed in claim 52, wherein said collision cell forms a substantially gas-tight enclosure.

57. A method of mass spectrometry as claimed in claim 33, wherein said predetermined daughter ions comprises ions selected from the group comprising: (i) immonium ions from peptides; (ii) functional groups including phosphate group $PO_3^-$ ions from phosphorylated peptides; and (iii) mass tags which are intended to cleave from a specific molecule or class of molecule and to be subsequently identified thus reporting the presence of said specific molecule or class of molecule.

58. A method of mass spectrometry as claimed in claim 33, wherein operating said fragmentation means in said first mode comprises the step of supplying a voltage to said fragmentation means selected from the group consisting of: (i) ≧15V; (ii) ≧20V; (iii) ≧25V; (iv) ≧30V; (v) ≧50V; (vi) ≧100V; (vii) ≧150V; and (viii) ≧200V.

59. A method of mass spectrometry as claimed in claim 33, wherein operating said fragmentation means in said second mode comprises the step of supplying a voltage to said fragmentation means selected from the group consisting of: (i) ≦5V; (ii) ≦4.5V; (iii) ≦4V; (iv) ≦3.5V; (v) ≦3V; (vi) ≦2.5V; (vii) ≦2V; (viii) ≦1.5V; (ix) ≦1V; (x) ≦0.5V; and (xi) substantially OV.

60. A method of mass spectrometry comprising the steps of:

providing an ion source which generates ions;

characterised in that said method further comprises the steps of:

passing the ions to a fragmentation means which operates in at least a first mode with an applied voltage ≧15V wherein at least a portion of the ions are fragmented to produce daughter ions and a second mode with an applied voltage ≦5V wherein substantially less of the ions are fragmented than in said first mode;

mass analysing at least some of the ions which have passed through said fragmentation means operating in said first mode;

mass analysing at least some of the ions which have passed through said fragmentation means perating in said second mode;

identifying at least one daughter ion and at least one candidate parent ion; and determining whether: (i) said at least one daughter ion corresponds with one or more predetermined daughter ions; and/or (ii) said at least one daughter ion and said at least one candidate parent ion could be related by the loss of a predetermined ion or neutral particle.

61. A mass spectrometer comprising:

an ion source for generating ions;

a fragmentation means switchable between at least a first mode wherein at least a portion of the ions received by said fragmentation means are fragmented to produce daughter ions and a second mode wherein substantially less of the ions are fragmented than in said first mode;

a mass analyser for mass analysing at least some of the ions which have passed through said fragmentation means operating in said first mode and for mass analysing at least some of the ions which have passed through said fragmentation means operating in said second mode; and a control system for controlling said mass spectrometer;

wherein said control system is arranged to identify at least one daughter ion and at least one candidate parent ion and to determine whether: (i) said at least one daughter ion corresponds with one or more predetermined daughter ions; and/or (ii) said at least one daughter ion and said at least one candidate parent ion could be related by the loss of a predetermined ion or neutral particle.

62. A mass spectrometer as claimed in claim 61, wherein said mass analyser is selected from the group comprising: (i) a quadrupole mass filter; (ii) a time-of-flight mass analyser; (iii) an ion trap; (iv) a magnetic sector analyser; and (v) a Fourier Transform Ion Cyclotron Resonance ("FTICR") mass analyser.

63. A mass spectrometer as claimed in claim 61, further comprising a multi-element ion optical lens for filtering ions so that ions having a mass-to-charge ratio within a first range are substantially transmitted and so that the transmission of ions having a mass-to-charge ratio outside of said first range is substantially reduced.

64. A mass spectrometer as claimed in claim 63, wherein said multi-element ion optical lens comprises a quadrupole mass filter.

65. A mass spectrometer as claimed in claim 61, wherein said fragmentation means comprises a collision cell selected from the group consisting of: (i) a quadrupole rod set; (ii) an hexapole rod set; (iii) an octopole rod set; and (iv) an electrode ring set.

66. A mass spectrometer as claimed in claim 65, wherein said collision cell forms a substantially gas-tight enclosure.

67. A mass spectrometer comprising:

an ion source for generating ions;

a fragmentation means switchable between at least a first mode with an applied voltage ≧15V wherein at least portion of the ions received by said fragmentation means are fragmented to produce daughter ions and a second mode with an applied voltage ≦5V wherein substantially less of the ions are fragmented than in said first mode; and a mass analyser for mass analysing at least some of the ions which have passed through said fragmentation means operating in said first mode and for mass analysing at least some of the ions which have passed through said fragmentation means operating in said second mode; wherein said mass spectrometer is configured to identify at least one daughter ion and at least one candidate parent ion and to determine whether: (i) said at least one daughter ion corresponds with one or more predetermined daughter ions; and/or (ii) said at least one daughter ion and said at least one candidate parent ion could be related by the loss of a predetermined ion or neutral particle.

* * * * *